US009899135B2

(12) United States Patent
Nakanoue et al.

(10) Patent No.: US 9,899,135 B2
(45) Date of Patent: Feb. 20, 2018

(54) REACTOR DEVICE

(71) Applicant: Hitachi Industrial Equipment Systems Co., Ltd., Chiyoda-ku, Tokyo (JP)

(72) Inventors: Kenji Nakanoue, Tokyo (JP); Naoyuki Kurita, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 423 days.

(21) Appl. No.: 14/414,931

(22) PCT Filed: Aug. 8, 2013

(86) PCT No.: PCT/JP2013/071566
§ 371 (c)(1),
(2) Date: Jan. 15, 2015

(87) PCT Pub. No.: WO2014/073252
PCT Pub. Date: May 15, 2014

(65) Prior Publication Data

US 2015/0179330 A1 Jun. 25, 2015

(30) Foreign Application Priority Data

Nov. 8, 2012 (JP) ..... 2012-246048
Jun. 27, 2013 (WO) ..... PCT/JP2013/067731

(51) Int. Cl.
*H01F 30/12* (2006.01)
*H01F 27/26* (2006.01)
(Continued)

(52) U.S. Cl.
CPC ..... *H01F 27/25* (2013.01); *H01F 27/263* (2013.01); *H01F 37/00* (2013.01); *H01F 27/306* (2013.01)

(58) Field of Classification Search
USPC ..... 336/5
See application file for complete search history.

(56) References Cited

U.S. PATENT DOCUMENTS 4,338,657 A 7/1982 Lisin et al.
4,599,594 A 7/1986 Siman
(Continued)

FOREIGN PATENT DOCUMENTS

CN 201820600 U 5/2011
CN 102306542 A 1/2012
(Continued)

OTHER PUBLICATIONS

European Search Report issued in counterpart European Application No. 13853556.2 dated Sep. 29, 2016 (12 pages).
(Continued)

*Primary Examiner* — Ronald Hinson
(74) *Attorney, Agent, or Firm* — Crowell & Moring LLP

(57) ABSTRACT

Provided is a device that reduces loss by means of a large-capacity, three-phase reactor device that eliminates high-frequency components arising in a power controller system used in solar power generation and the like. The present invention is provided with: a yoke core that uses an amorphous ribbon; magnetic leg cores formed into a fan shape using an amorphous ribbon; and a coil wound around the magnetic leg cores. The yoke core is disposed in an approximately hexagonal bottom fastening fixture, the magnetic leg cores are disposed stacked at three equally spaced locations on the inner peripheral surface of the yoke core, the coil is inserted and disposed at the stacked magnetic leg cores, the yoke core is disposed above the magnetic leg cores, the yoke core is covered by an approximately hexagonal top fastening fixture, studs are disposed at the center of the outer periphery of three respectively corresponding sides of the bottom fastening fixture and the top fastening fixture, studs are further disposed at the center of the bottom fastening fixture and the top fastening fixture, the bottom fastening fixture and the top fastening fixture are clamped
(Continued)

and affixed by the studs, and furthermore the coil is affixed by a coil affixing fixture disposed at the studs of the three sides.

19 Claims, 40 Drawing Sheets

(51) Int. Cl.

| | |
|---|---|
| ***H01F 27/06*** | (2006.01) |
| ***H01F 27/25*** | (2006.01) |
| ***H01F 37/00*** | (2006.01) |
| *H01F 27/30* | (2006.01) |

(56) References Cited

U.S. PATENT DOCUMENTS

| | | | | |
|---|---|---|---|---|
| 6,160,464 | A | 12/2000 | Clarke et al. | |
| 7,148,782 | B2 * | 12/2006 | Hirzel | H01F 27/25 310/208 |
| 2009/0257560 | A1 | 10/2009 | Khutoryansky et al. | |
| 2011/0095642 | A1 | 4/2011 | Enomoto et al. | |
| 2013/0200967 | A1 | 8/2013 | Xu et al. | |
| 2014/0268896 | A1 | 9/2014 | Kurita et al. | |
| 2014/0292455 | A1 | 10/2014 | Kurita et al. | |

FOREIGN PATENT DOCUMENTS

| | | | |
|---|---|---|---|
| EP | 2 490 231 | A1 | 8/2012 |
| GB | 187 921 | A | 11/1922 |
| JP | 59-89526 | U | 6/1984 |
| JP | 61-1823 | U | 1/1986 |
| JP | 61-224306 | A | 10/1986 |
| JP | 4-345009 | A | 12/1992 |
| JP | 9-74031 | A | 3/1997 |
| JP | 10-114534 | A | 5/1998 |
| JP | 2006-303066 | A | 11/2006 |
| JP | 2008-218660 | A | 9/2008 |
| JP | 2011-91932 | A | 5/2011 |
| JP | 2011-142149 | A | 7/2011 |
| WO | WO 2005/027155 | A1 | 3/2005 |
| WO | WO 2012/157053 | A1 | 11/2012 |
| WO | WO 2013/065095 | A1 | 5/2013 |

OTHER PUBLICATIONS

International Search Report dated Oct. 8, 2013 with English translation (five (5) pages).

* cited by examiner (a)

(b)

(c)

(a)

(b)

REACTOR DEVICE

TECHNICAL FIELD

The present invention relates to reactor devices for eliminating high-frequency components arising in a power controller system used in solar power generation when DC power is converted to AC power by means of an inverter. More particularly, the invention relates to a reactor device employing an amorphous material.

BACKGROUND ART

There is known a reactor device using an amorphous material for iron cores of a large-capacity three-phase reactor device in order to reduce loss (iron loss) during operation. Such a reactor device is disclosed in Patent Literature 1 (Japanese Patent Application Laid-Open No. 2008-218660).

CITATION LIST

Patent Literature

Patent Literature 1: Japanese Patent Application Laid-Open No. 2008-218660

SUMMARY OF INVENTION

Technical Problem

Patent Literature 1 discloses the reactor device which includes: a toroidal core having a leg portion formed by stacking a plurality of ring-like core units in a magnetization direction; and a coil and in which the whole or a part of the core unit is formed of an amorphous metal. However, Patent Literature 1 teaches the structures of the core and the coil, and does not teach the structure of the whole body of the reactor device.

The invention has an object to provide a reactor device that employs an amorphous core for reducing the loss.

Solution to Problem

As a solution to the above problem, a structure defined by the claims of the invention, for example, is adopted. While the present application includes a plurality of means for solving the above problem, one example thereof is a reactor device which includes: a yoke core formed by toroidally winding an amorphous ribbon; a magnetic leg core formed of the amorphous ribbon; and a coil wound around the magnetic leg core, wherein the yoke core is disposed in a bottom fastening fixture, the magnetic leg cores are stacked and arranged at three places on a circumference of the yoke core with equal spacing, the coil is slidingly fitted around the magnetic leg core, the yoke core is disposed atop the magnetic leg cores, the yoke core is capped with a top fastening fixture, three studs are arranged around the circular bottom fastening fixture and top fastening fixture with equal spacing and another stud is disposed at the center of the bottom fastening fixture and top fastening fixture, and the bottom fastening fixture and top fastening fixture are fastened and fixed by means of the studs.

Advantageous Effects of Invention

According to the invention, the reactor device employs the amorphous material for the iron cores and thence, can achieve decrease in loss and size reduction. In a manufacturing method, the magnetic leg cores can be positioned and fixed with the studs and the like while the coils can be highly precisely positioned and fixed with coil metal fixtures. Thus, the three legs can be balanced with one another.

DESCRIPTION OF EMBODIMENTS

The embodiments of the invention will hereinbelow be described with reference to the accompanying drawings.

Example 1

Figure 1:
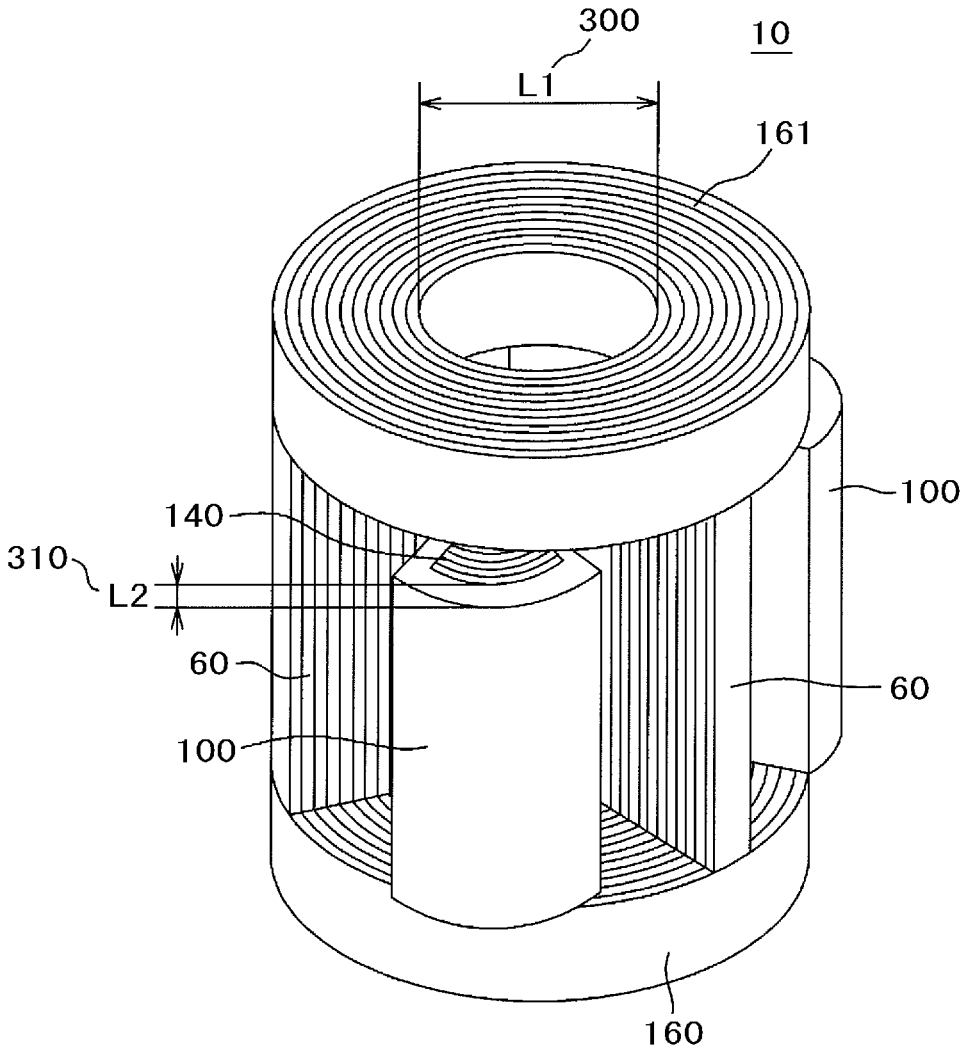
FIG. 1 is a perspective view of a structure of a reactor device for illustrating the principle of the reactor device employing an amorphous core according to the invention.

A basic structure of a reactor device of the invention is described with reference to FIG. 1. FIG. 1 is a perspective view showing the basic structure of the reactor device. In FIG. 1, numerals 160 and 161 denote a yoke core; a numeral 140 denotes a magnetic leg core; a numeral 100 denotes a coil; and a numeral 60 denotes a zero-phase core. The yoke core 160 or 161 is formed by winding an amorphous ribbon into a toroidal shape (annular shape), having a thick hollow circular configuration.

The magnetic leg core 140 has a fan-like configuration. It is noted here that the term "fan-like configuration" as used herein includes: a structure formed by axially cutting a toroidally wound amorphous ribbon into blocks having the fan-like configuration and stacking the plural fan-like blocks on top of each other; and polygonal structures such as described in conjunction with Example 13 (see FIG. 34B, FIG. 34C). The characteristic of this fan-like configuration will be described in detail in conjunction with Examples 9 and 13. This embodiment is described as below in conjunction with the above-described structure formed by axially cutting the toroidally wound amorphous ribbon into the fan-like blocks and stacking the plural fan-like blocks on top of each other. In the case of such a fan-like magnetic leg core, inside and outside circumferences thereof are aligned on circles similarly to those of the yoke core. When the yoke core laps over the magnetic leg cores, therefore, the magnetic leg cores have the minimum area that is not overlapped with the yoke core so that the loss and a useless increase of the mass can be obviated.

The periphery of the magnetic leg core 140 is formed by winding the coil 100 therearound. The yoke cores 160 and 161 are disposed at upper and lower ends of the reactor device in opposed relation. Three pairs of magnetic leg cores 140 and coils 100 are disposed between the yoke cores 160 and 161, magnetically interconnecting the upper and lower yoke cores.

The reason for the reactor device to include the three coils 100 wound around the magnetic leg cores 140 is to arrange the reactor device to function as a three-phase AC reactor device. The magnetic leg cores 140 and the coils 100 are arranged on a circumference of the yoke cores with an angular spacing of about 120° with respect to the co-axis of the yoke cores 160 and 161 having the hollow circular configuration. This is for the purpose of ensuring electrical symmetry.

The reactor device further includes the zero-phase cores 60 which are each formed by stacking a plurality of rectangular amorphous ribbons into a rectangular parallelepiped configuration. The zero-phase cores are arranged on the circumference about the co-axis of the yoke cores 160 and 161 having the hollow circular configuration, as shifted through about 60° from the respective positions of the magnetic leg cores 140 (or with an angular spacing of about 120° between the three zero-phase cores 60). Similarly to the magnetic leg cores 140, the zero-phase cores magnetically interconnect the yoke cores 160 and 161. These zero-phase cores 60 are disposed to provide a flow path for magnetic flux due to zero-phase impedance induced when the phases of the three-phase AC current through the coils 100 wound around the three magnetic leg cores 140 are shifted from an idealistic condition. That is the description of the basic structure of the reactor device of the invention.

In FIG. 1, the toroidally wound yoke cores 160 and 161 are configured to satisfy a relation L1>2*L2, where L1 (300) denotes the inside diameter of the yoke core, and L2 (310) denotes the thickness of the coil 100 wound around the magnetic leg core 141. Such a configuration satisfying the above relation is preferred because if the yoke core is decreased in the inside diameter of the York core L1 (300), an effect to radiate heat from the coils is reduced although the reactor device can be reduced in size.

Next, the structure of the reactor device of the invention is described with reference to FIG. 2A to FIG. 2F. In FIG. 2A to FIG. 2F, a numeral 10 denotes the reactor device; a numeral 20 denotes a top fastening fixture; a numeral 30 denotes a bottom fastening fixture; a numeral 40 denotes an inner coil terminal; a numeral 41 denotes an outer coil terminal; a numeral 50 denotes an eyenut for hanging a reactor body; a numeral 60 denotes the zero-phase core; a numeral 70 denotes a stud metal fixture; a numeral 80 denotes a zero-phase core support; a numeral 81 denotes a zero-phase core holder; a numeral 90 denotes a stud attached to an outside periphery of the reactor body; a numeral 91 denotes a stud disposed centrally of the reactor body; a numeral 100 denotes the coil; a numeral 120 denotes a coil support fixture; a numeral 130 denotes a base; a numeral 140 denotes the magnetic leg core; a numeral 150 denotes a coil support fixture; a numeral 152 denotes a coil nut for fixing the coil support fixture; and numerals 160 and 161 denote the yoke core.

Figure 2A:
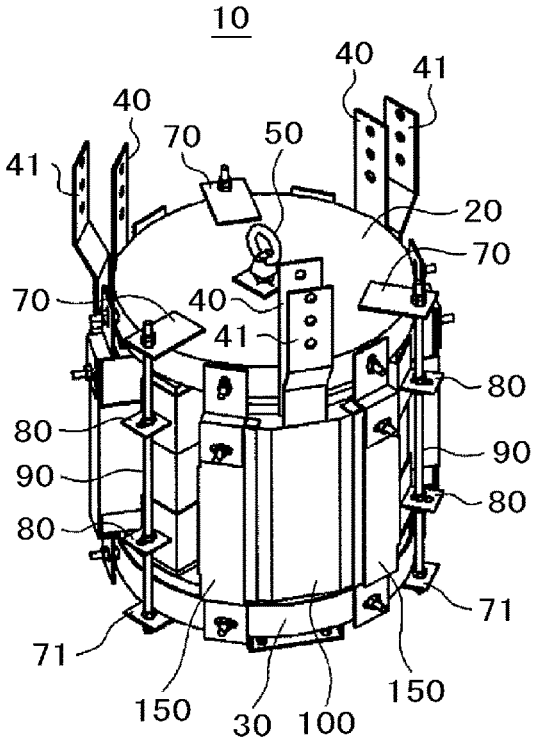
FIG. 2A is a perspective view showing the overall structure of the reactor device employing the amorphous core according to the invention.
Figure 2B:
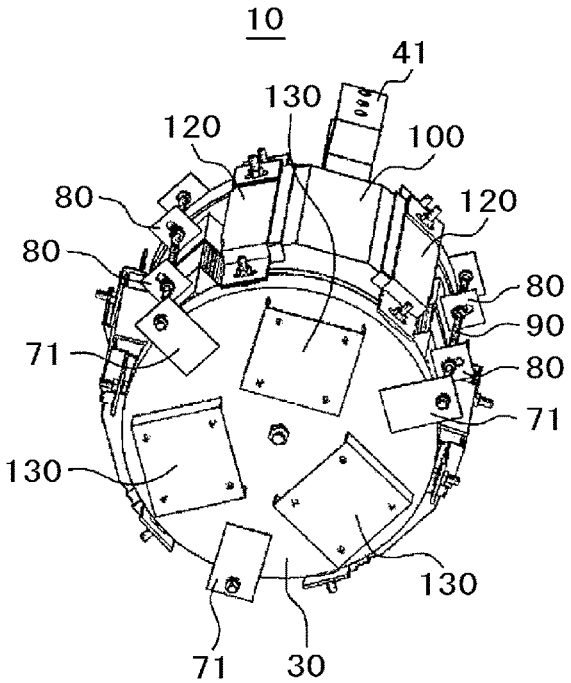
FIG. 2B is a perspective view of the overall structure of the reactor device as seen from a bottom side of the structure of FIG. 2A.
Figure 2C:
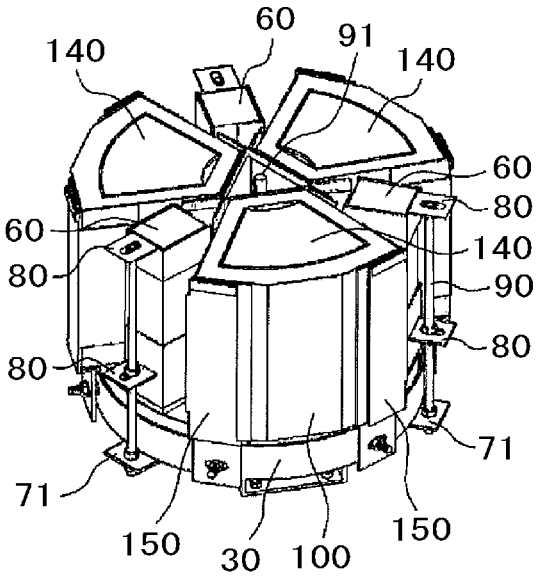
FIG. 2C is a perspective view of the device mounted with zero-phase cores, magnetic leg cores and coils according to the invention.
Figure 2D:
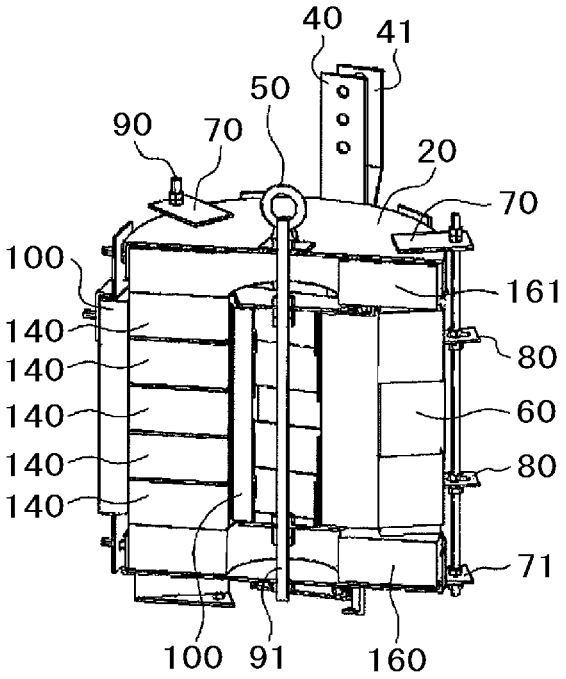
FIG. 2D is a vertical sectional view showing the interior of the reactor device of FIG. 2A.

First, an internal structure of the reactor device of the invention is described with reference to FIG. 2C and FIG. 2D. The magnetic leg core 140 has the fan-like configuration narrowed toward the central axis. The coil 100 is wound around this fan-like magnetic leg core 140. A laminate 171 is placed on the bottom fastening fixture 30 and the magnetic leg cores 140 and coils 100 are arranged on the laminate 171 with an angular spacing of 120°. As shown in FIG. 2D, the magnetic leg cores 140 of a predetermined height are stacked on top of each other with a laminate interposed between a respective pair of magnetic leg cores. The coil 100 is wound around the whole of the magnetic leg cores 140.

The magnetic leg cores 140 and coils 100 are sandwiched between the lower toroidally wound yoke core 160 and the upper toroidally wound yoke core 161. The lower yoke core 160 is accommodated and fixed in a case of the bottom fastening fixture 30 while the upper yoke core 161 is fixed in position as capped with a case of the top fastening fixture 20. The zero-phase cores 60 are arranged on the circumference with an equal angular spacing of 120° and disposed in between the coils. The zero-phase cores are each formed by stacking a plurality of rectangular amorphous ribbons into a rectangular parallelepiped configuration and insertably fixed in the rectangular zero-phase core holder 81 connected to the zero-phase core support 80 mounted to the stud 90. Similarly to the magnetic leg cores 140, the zero-phase cores 60 are sandwiched between the lower yoke core 160 and the upper yoke core 161.

Respective magnetic paths are formed by arranging the three magnetic leg cores 140 and the zero-phase cores 60 to have the same height and to be sandwiched between the yoke cores 160 and 161 in this manner. Assembly work requires adjustment of gap between the magnetic leg cores 140 and the yoke cores 160 and 161 with accuracy of a millimeter order.

The studs 90 each supporting the zero-phase core 60 are arranged around the outside circumference of the reactor body 10 where the zero-phase cores are arranged. A shaft portion of the stud is threaded in the whole length thereof. A shaft portion of the central stud 91 is also threaded in the whole length thereof in a similar manner. An upper side of the stud 90 is fixed by tightening a locknut down on the stud metal fixture 70 which is fixedly connected to the top fastening fixture 20 by welding or the like and which is formed of a rectangular metal plate formed with a stud hole. A lower side of the stud 90 is fixed by tightening a locknut down on the stud metal fixture 71 which is fixedly connected to the bottom fastening fixture 30 by welding or the like and which is formed of a rectangular metal plate formed with a stud hole.

The stud 90 is provided with two zero-phase core supports 80 each formed of the rectangular metal plate formed with the stud hole and fixedly connected with the zero-phase core holder 81 formed of a rectangular frame body of metal plate for holding the zero-phase core 60. The stud 90 is inserted through the stud holes in the zero-phase core supports 80, which are fixed to predetermined positions on the stud by fastening the locknuts. The central stud 91 assists in fastening the top fastening fixture 20 and the bottom fastening fixture 30 while the three studs 90 arranged on the outside circumference of the reactor body 10 also assist in fastening and fixing the top fastening fixture 20 and the bottom fastening fixture 30. Attached to a distal end of the central stud 91 is the eyenut 50 used for hanging the reactor body 10.

The coil 100 is fixed in position as pressed against the triangular coil support fixture 120 disposed centrally of the reactor body 10 and fastened by the coil support fixture 150 from outside. The coil support fixture 150 is formed of an elongate metal plate and consists of two pieces. Bolts are fixedly welded to a lateral side of the bottom fastening fixture 30 while bolts are also fixedly welded to a lateral side of the top fastening fixture 20 disposed upward of the above-described bolts. The lower piece is formed of an elongate, rectangular metal plate, one end of which is folded stepwise and formed with a hole for insertion of a bolt therethrough and the other end of which has a bolt welded thereto. The coil support fixture 150 is mounted to the bottom fastening fixture 30 by inserting the bolt of the bottom fastening fixture through the hole of the coil support fixture. The metal plate as the upper piece is substantially centrally folded stepwise and formed with a bolt insertion hole in each of the step faces thereof. The upper piece is fixed in position by inserting the bolt of the top fastening fixture 20 and the bolt of the lower piece through the holes and tightening down respective nuts. While the figure illustrates the bottom fastening fixture 30 having the two-piece structure, the bottom fastening fixture may also be formed in one-piece structure using one plate member.

Figure 2E:
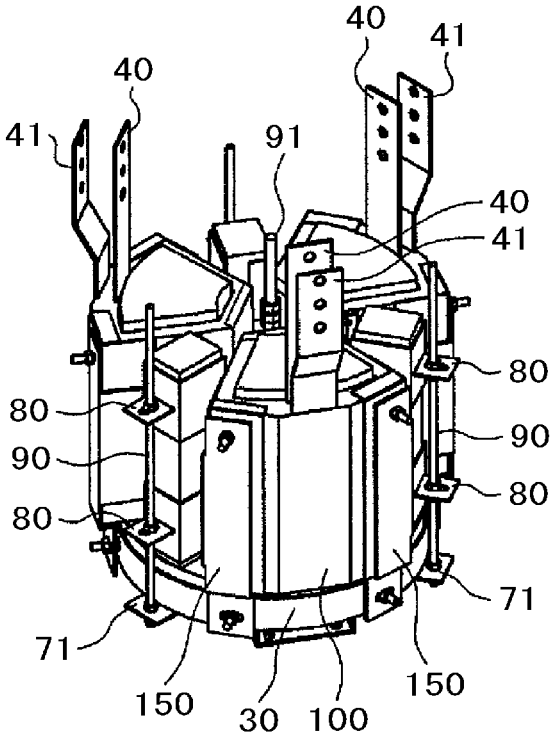
FIG. 2E is a perspective view showing a reactor device mounted with the zero-phase cores, magnetic leg cores and coils according to the invention.

In FIG. 2E, the coil terminals 40 and 41 are drawn up from the winding start and the winding end of the coil 100 so as to be connected to a power circuit of a power controller system. Further, an electric insulating paper is wound around the coil 100 to protect the surface thereof.

Figure 2F:
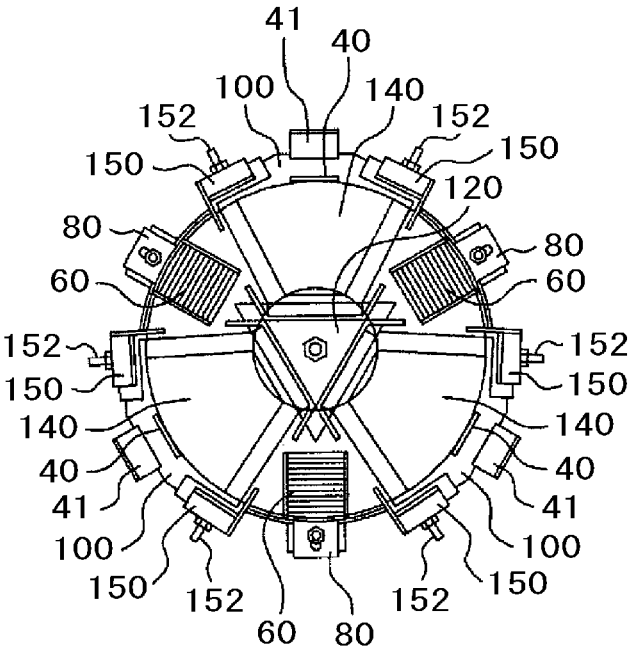
FIG. 2F is a horizontal sectional view showing the interior of the reactor device of FIG. 2A.

FIG. 2F is a top cross-sectional view taken at the height of the center of the reactor shown in FIG. 2E. Referring to FIG. 2F, the fan-like magnetic leg cores 140 with the coils 100 wound therearound are arranged in a manner that outside peripheries of the fan-like magnetic leg cores 140 coincides with outside peripheries of the top fastening fixture 20 and the bottom fastening fixture 30. That is, the fan-like coils are arranged so that outside peripheral portions thereof protrude from the top fastening fixture and the bottom fastening fixture. The fan-like coils are arranged with an angular spacing of 120°. The coil terminals are arranged at the outside peripheral portions of the coil 100. The inner coil terminal 40 and the outer coil terminal 41 are spaced a predetermined distance from each other. The central sides of the magnetic leg core 140 and coil 100 are linearly formed but not in an arcuate shape so as to be precisely positioned and fixed as pressed against the triangular coil support fixture 120. While FIG. 2F illustrates the coil 100 having the linear central side, the central side of the coil may also be in the arcuate shape and the coil support fixture 120 may also be formed in the arcuate shape. The magnetic leg core 140 and coil 100 are arranged such that the coil 100 has opposite ends laterally of the outer terminal fixed with coil support fixtures. The zero-phase cores 60 are interposed between the coils 100. The zero-phase cores are arranged with equal angular spacing of 120°. The zero-phase core 60 is formed by stacking elongate, rectangular amorphous metal plates and arranged in parallel to the center axis of the circular reactor. The zero-phase core support 80 is arranged on an outside periphery of the zero-phase core 60 to support the zero-phase core 60.

Next, an outside appearance of the reactor device of the invention is described with reference to FIG. 2A and FIG. 2B. FIG. 2A is an external view of the reactor device as seen from diagonally above. FIG. 2B is an external view of the reactor device as seen from diagonally below. Referring to FIG. 2A and FIG. 2B, the coil 100 is fixed in position by fastening the upper and lower pieces of the coil support fixture 150 and by fastening the top fastening fixture 20 and the bottom fastening fixture 30. The zero-phase core 60 is supported and fixed in position by the zero-phase core supports 80 mounted to the stud 90 at two positions. This stud 90 is fixed in position by assembling the stud with the stud metal fixture 70 fixed to the top fastening fixture 20 and with the stud metal fixture 71 fixed to the bottom fastening fixture 30 and by fastening the top fastening fixture 20 and the bottom fastening fixture 30. On a bottom of the reactor 10, the three U-shaped bases 130 are arranged on an outside circumference with equal spacing and fixed in position.

Example 2

Figure 3:
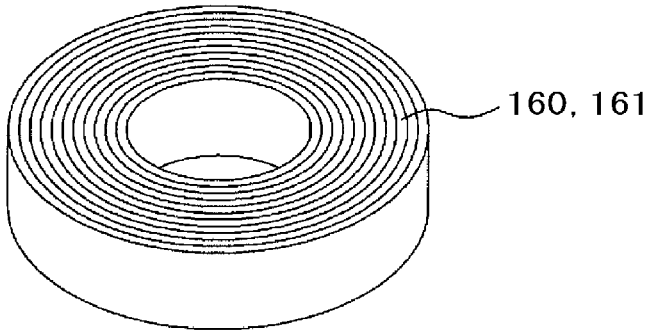
FIG. 3 is a group of external perspective views of a yoke core, the magnetic leg core and the zero-phase core.
Figure 3:
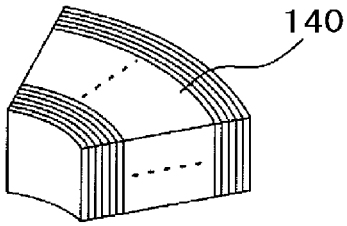
Figure 3:
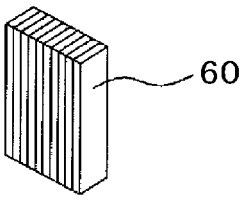

Next, description is made on a manufacturing method of the reactor device of the invention. The manufacturing method of the reactor device employing the fan-like magnetic leg core 140 is described with reference to FIG. 3 to FIG. 12. In FIG. 3, FIG. 3(*a*) is a perspective view showing the yoke cores 160 and 161 disposed at the upper and lower parts of the reactor 10 and arranged to sandwich the magnetic leg cores 140 and the zero-phase cores 60 therebetween. While the yoke core of FIG. 3(*a*) is depicted as concentric circles, the yoke core actually has a cylindrical configuration formed by toroidally winding an amorphous ribbon and including a central hole. FIG. 3(*b*) is an external perspective view of the magnetic leg core 140. The magnetic leg core is formed in the fan-like configuration by axially cutting the iron core formed by toroidally winding the amorphous ribbon. FIG. 3(*c*) is an external perspective view of the zero-phase core 60 which is formed by stacking the elongate rectangular amorphous ribbons into the rectangular parallelepiped configuration.

Figure 4:
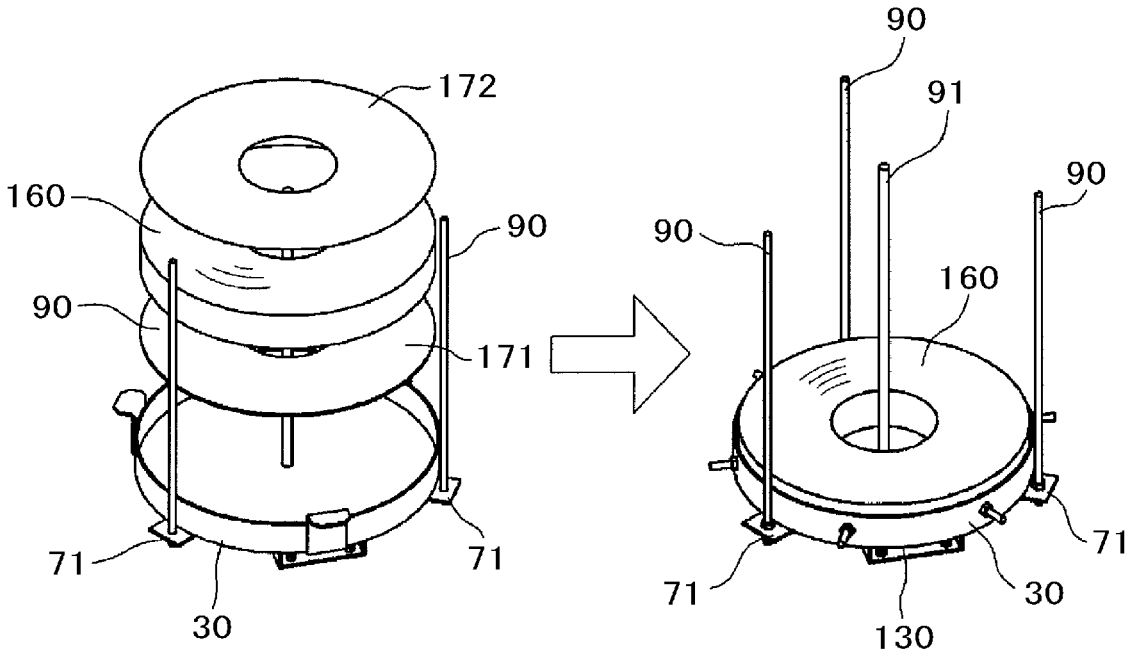
FIG. 4 is a group of perspective views showing a step of mounting a laminate and the yoke core to a bottom fastening fixture.

Next, the manufacturing method of the reactor of the invention is described referring to the figures in the order of assembly steps. FIG. 4 diagrammatically shows the assembly of the lower yoke core. Referring to FIG. 4, the stud metal fixtures 71 are first fixed to a bottom of the bottom fastening fixture 30 by welding or the like. The studs 90 are assembled to the stud metal fixtures while the stud 91 is also disposed at the center of the device. The studs 90 are fixed in position by tightening locknuts. Subsequently, in this state, the laminate 171 shaped like a hollow disk is placed in the bottom fastening fixture 30. Further, the yoke core 160 is placed on the laminate and then, a laminate 172 is placed on the yoke core 160. The right-hand diagram of FIG. 4 shows the state where the yoke core 160 is placed.

Figure 5:
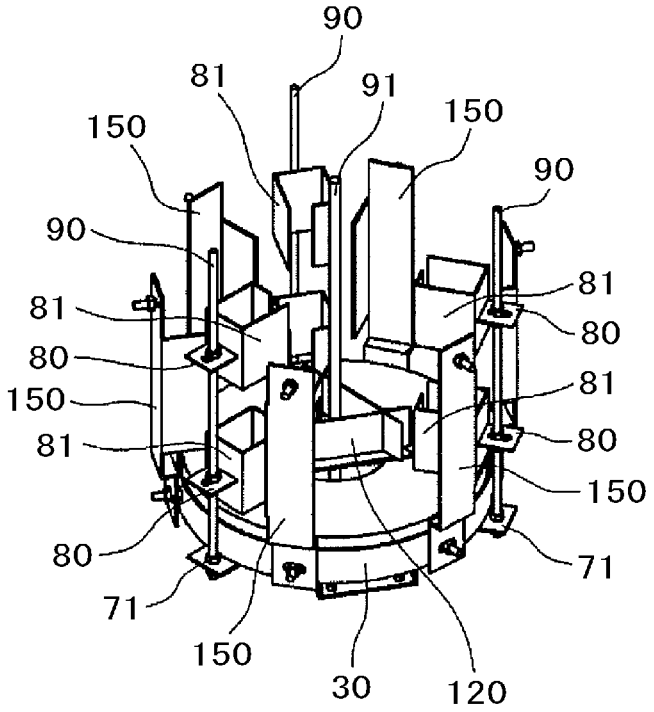
FIG. 5 is a perspective view showing a step of mounting zero-phase core holders for mounting the zero-phase cores to studs arranged on the bottom fastening fixture.

Next, a step of mounting a coil metal fixture is described with reference to FIG. 5. In a structure shown in FIG. 5, the coil support fixture 120 against which the coil 100 is pressed for positioning is mounted about the central stud 91. Subsequently, the two zero-phase core supports 80 each connected to the zero-phase core holder 81 formed of the metal frame for holding the zero-phase core 60 are mounted to each of the three studs 90 arranged on the outside periphery of the reactor body 10. The zero-phase core supports 80 are fixed to places on the stud by tightening down the locknuts. Subsequently, the six coil fasteners 150 for fixing the coils 100 are tack welded to places on the outside circumference of the bottom fastening fixture 30 and mounted thereto.

Figure 6:
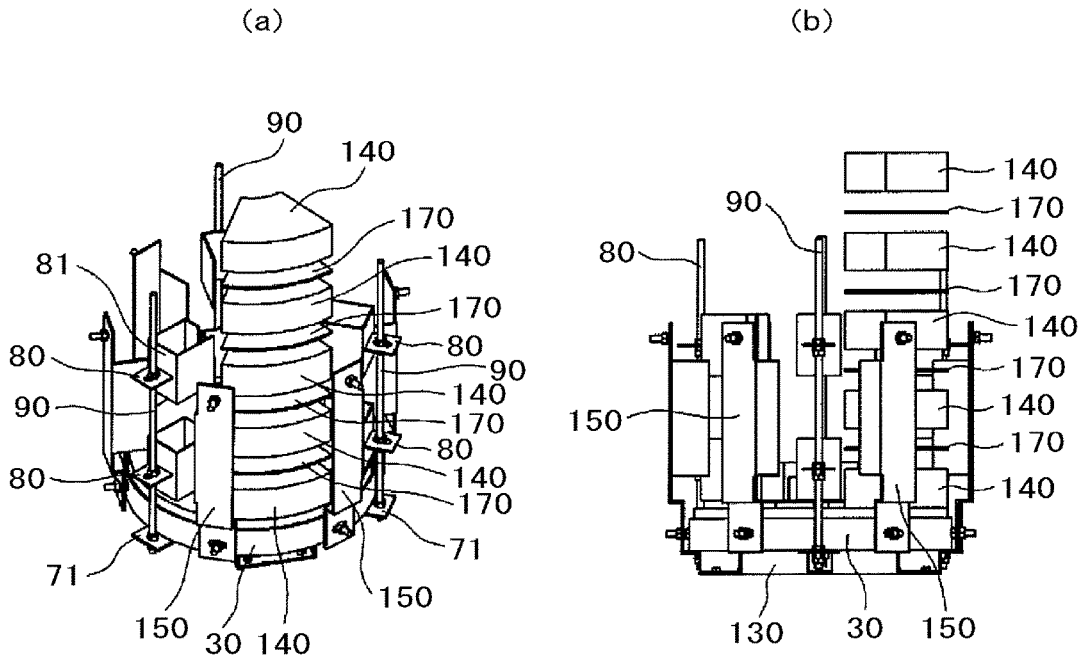
FIG. 6 is a group of perspective views showing a step of stacking and mounting the magnetic leg cores.

Next, the assembly of the magnetic leg core 140 is described with reference to FIG. 6. In FIG. 6, FIG. 6(*a*) is an external perspective view of the reactor device while FIG. 6(*b*) is a side view thereof. Referring to FIG. 6(*a*), the fan-like magnetic leg cores 140 are placed on the yoke core 160. Subsequently, the laminate 170 is placed on the magnetic leg cores 140 and then, the magnetic leg cores 140 are placed on the laminate 170. This step is repeated to stack five magnetic leg cores 140 with the laminate 170 inserted between respective pairs of magnetic leg cores 140. In this process, the inductance value (L value) can be adjusted because the inductance value (L value) of the reactor can be varied by changing the thickness of the laminate 140, that is, the gap between the magnetic leg core 140 and the magnetic leg core 140.

Figure 7:
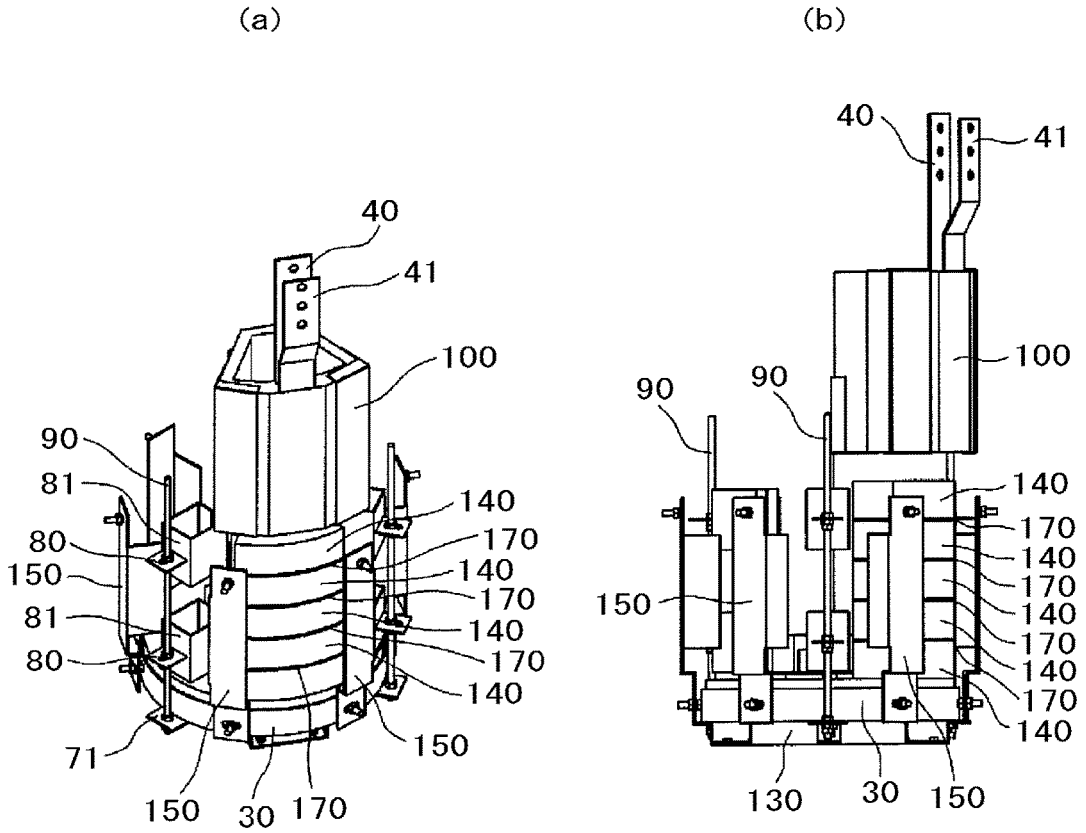
FIG. 7 is a group of perspective views showing a step of slidingly fitting the coil around the magnetic leg core.

The assembling of the coil is described with reference to FIG. 7. In FIG. 7, FIG. 7(*a*) is an external perspective view of the reactor device, while FIG. 7(*b*) is a side view thereof. Referring to FIG. 7(*a*) and FIG. 7(*b*), the coil 100 has a fan-like configuration conforming to the fan-like configuration of the magnetic leg core 140. The coil 100 covered with the insulating material (electric insulating paper) is slidingly fitted from above around the stack of magnetic leg cores 140 alternating with the laminates 170. The coil support fixtures 150 are adjusted in position before fixed to places. Further, adjustment is made to eliminate backlash by inserting the electric insulating paper in a gap between the coil 100 and the coil support fixture 120 and a gap between the coil 100 and the magnetic leg core 140.

Figure 8:
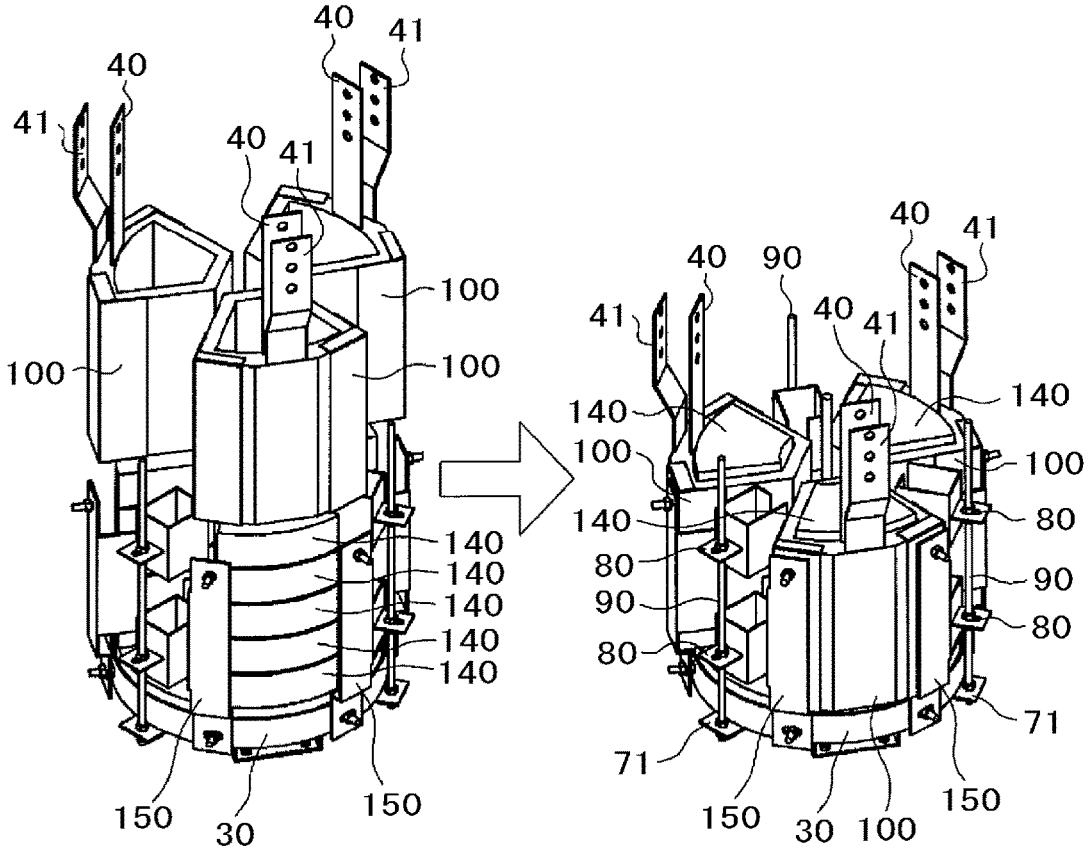
FIG. 8 is a group of perspective views showing the step of mounting the coils on the three magnetic leg cores, respectively.

Next, a step of assembling the coils 100 with the magnetic leg cores 140 for forming three legs by repeating the step of stacking the magnetic leg cores 140 shown in FIG. 6 and the step of slidingly fitting the coil 100 around the magnetic leg core 140 shown in FIG. 7 is shown in FIG. 8. FIG. 8 shows the step of slidingly fitting the coils 100 around the three magnetic leg cores 140 respectively. After fitting, the electric insulating paper is filled in the gaps to eliminate the backlash.

Figure 9:
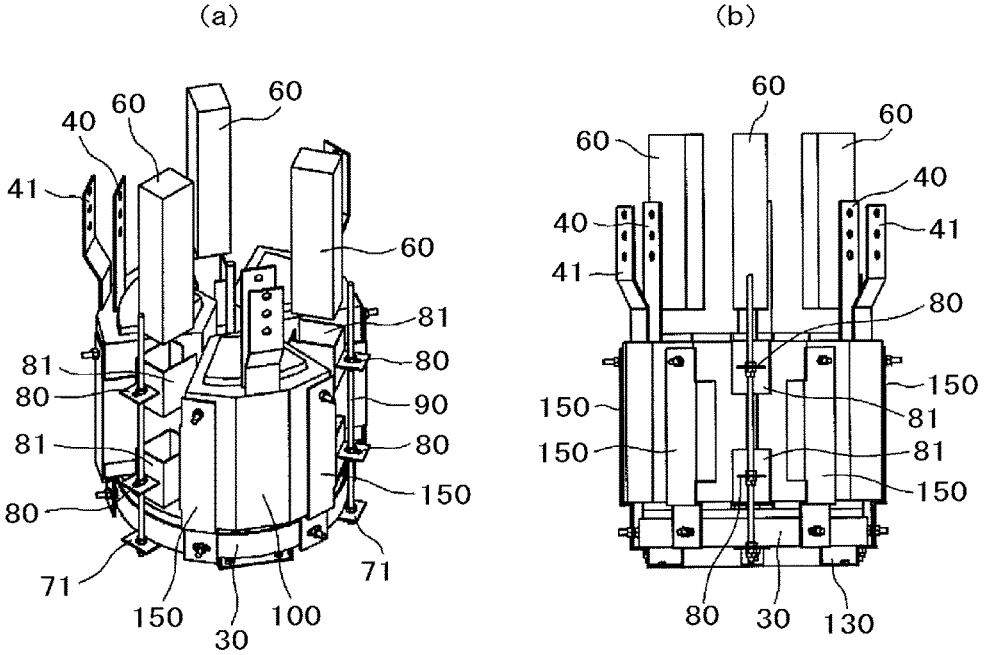
FIG. 9 is a group of perspective views showing a step of mounting the zero-phase cores.

Next, a step of mounting the zero-phase core 60 is described with reference to FIG. 9. In FIG. 9, FIG. 9(*a*) is an external perspective view showing how to mount the zero-phase core 60, while FIG. 9(*b*) is a front view thereof. The zero-phase core 60 is covered with the insulating material (electric insulating paper), inserted from above in the zero-phase core holder 81 formed of the metal frame and fixedly mounted on the yoke core 160. As shown in FIG. 9(*a*), the zero-phase core holder 81 is formed with a vertical cutout in the opposite side from the zero-phase core support 80. There is no problem if the zero-phase core holder has a frame structure without this cutout.

The zero-phase cores 60 need be mounted in a manner to produce no backlash. If the backlash occurs, the electric insulating paper or the like is used to make a backlash free structure. It is also necessary to equalize the heights of the zero-phase core 60 and the magnetic leg core 140. Therefore, height adjustment is made using the electric insulating paper is used for making when the zero-phase core and the magnetic leg core have different heights. A SUS type metal may be used as the metal plate. The zero-phase core 60 is formed by stacking the amorphous ribbon and cutting the stack into a rectangular shape or into the rectangular parallelepiped configuration. Instead of the amorphous ribbon, other metal materials such as silicon steel are also usable.

Figure 10:
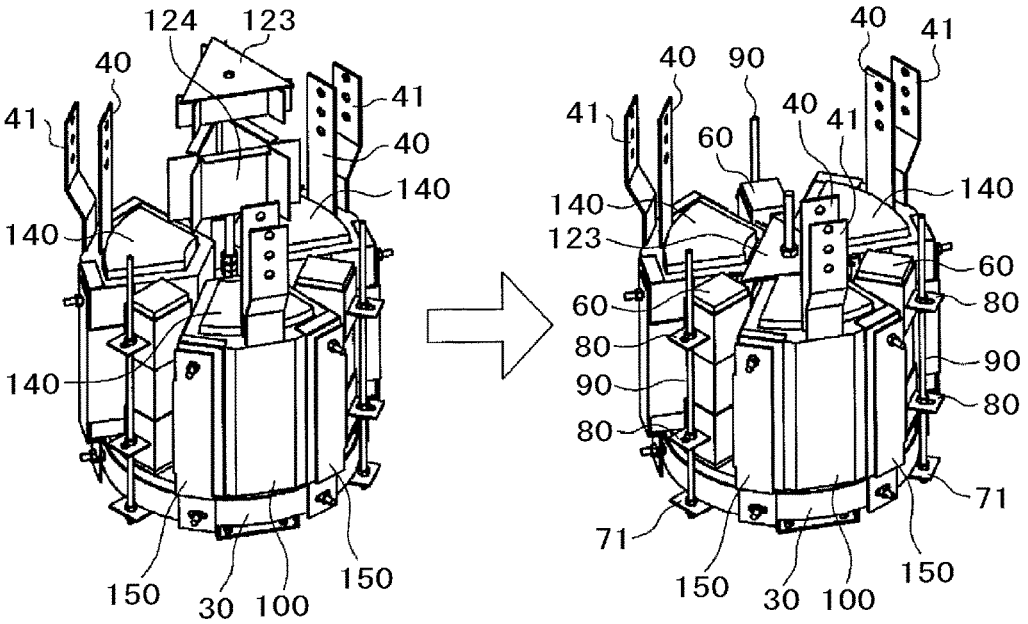
FIG. 10 is a group of perspective views showing a step of fixing the three coils.

Next, a step of fixing an upper side of the coil 100 is described with reference to FIG. 10. Referring to FIG. 10, in a state where the coils 100 are fixed with the coil support fixtures 150, a triangular insulating material 124 is inserted from above into the center part of the reactor device 10. Then, a coil support fixture 123 is inserted from above. The insulating material 124 is intended to secure an insulation distance between the coils 100 constituting three legs, serving to prevent insulation breakdown and the like. A structure of the insulating material has a triangular prism tube configuration. Each of the ridge parts of the triangular prism is formed with a wing part for covering the coil end. A top of the triangular prism tube body is closed with a metal plate centrally formed with a hole for the stud 91 to penetrate. After the assembly step of inserting the insulating material 124 and coil support fixture 123, the stud 91 is fixed in position by tightening down the locknut.

Figure 11:
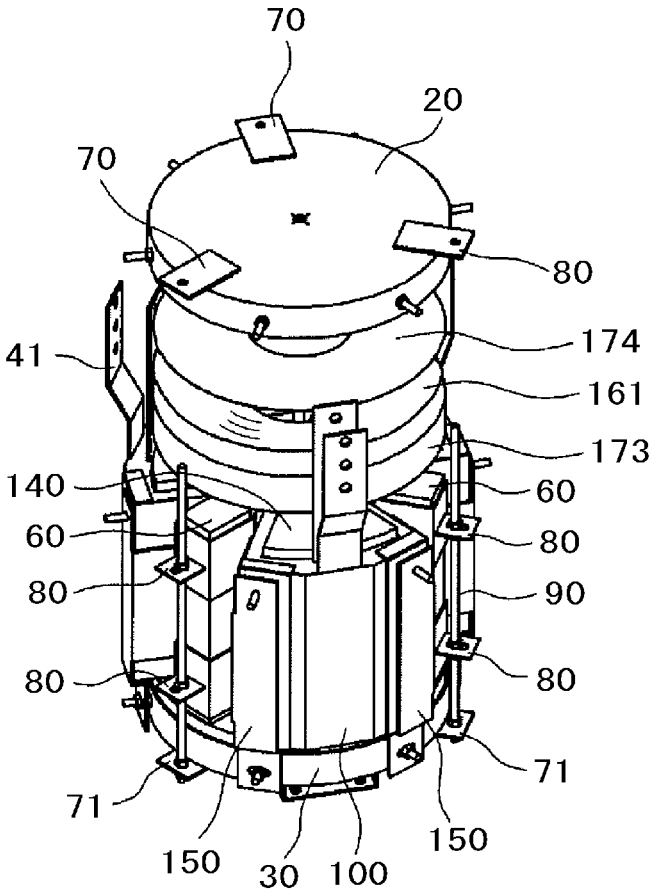
FIG. 11 is a perspective view showing a step of mounting the laminate and the yoke core and capping them with a top fastening fixture.

Next, a step of mounting the upper yoke core is described. FIG. 11 is an external perspective view showing how the upper yoke core is mounted. In FIG. 11, the numeral 161 denotes the upper yoke core; numerals 173 and 174 denote laminates; the numeral 20 denotes the top fastening fixture; and the numeral 70 denotes an upper stud metal fixture. Referring to FIG. 11, the laminate 173 is disposed between the magnetic leg core 140 and the yoke core 161 and the yoke core 161 is mounted on the laminate 173. The laminate 174 is mounted atop the yoke core 161. The top fastening fixture 20 is placed on the laminate and assembled together as positioned in a manner to allow the studs 90 to penetrate the holes formed in the stud metal fixtures 70 and to allow the stud 91 to penetrate the center hole of the top fastening fixture 20. After assembling the laminate 173, the yoke core 161, the laminate 174 and the top fastening fixture 20 in this order, a fastening fixture 51 is mounted on the stud 91. In this process, the lateral side of the yoke core 161 is covered with the electric insulating paper so as to eliminate the backlash in the assembly.

Figure 12:
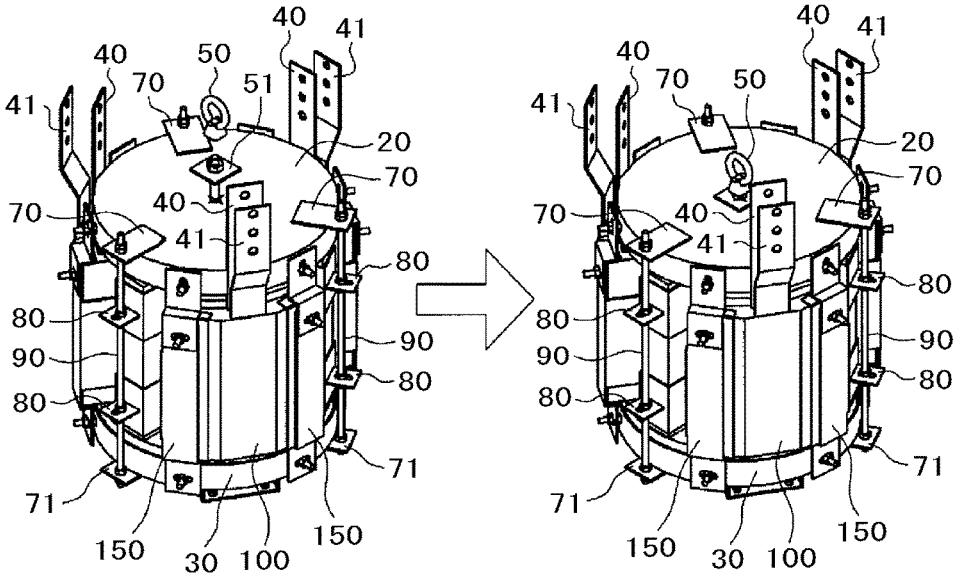
FIG. 12 is a group of perspective views showing a step of mounting an eyenut for hanging the reactor device.

Next, the mounting of the eyenut for hanging the reactor body 10 is described. FIG. 12 is a group of external perspective views of the rector 10 showing how the eyenut is mounted to the reactor and a state where the assembly work is completed. Referring to FIG. 12, the magnetic leg cores 140, the zero-phase cores 60 and the yoke core 161 sandwiched between the bottom fastening fixture 30 and the top fastening fixture 20 are fastened and fixed in position by mounting the fastening fixture 51 to the stud 91 penetrating the center hole of the top fastening fixture 20 and tightening down the fastening fixture. The coil support fixtures 150 are mounted to the bolts fixed to the lateral side of the top fastening fixture 20 and fixed thereto by tightening the locknuts. Subsequently, the eyenut 50 is threaded in a tip end of the stud 91. Lines of the coil terminals 40 and 41 drawn from the coil 100 are inserted in insulation tubes to mutually separate the lines by a predetermined length or more. The above-described structure is checked using an LCR meter to determine whether U-, V-, W-phase inductance values (L values) of the reactor body are predetermined values or not. If the inductance value differs from the predetermined value, the assembly work returns to the step of assembling the magnetic leg core shown in FIG. 6 to adjust the gap between the magnetic leg cores. That is the description on the manufacturing method of the reactor employing the fan-like magnetic leg core.

Example 3

Figure 13:
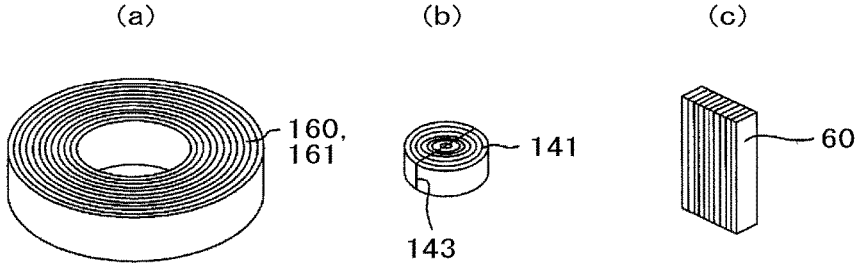
FIG. 13 is a group of external perspective views showing a yoke core, a magnetic leg core and a zero-phase core according to Example 3, respectively.

Next, description is made on a manufacturing method of a reactor device according to a third embodiment of the invention. FIG. 13 is a group of perspective views showing iron cores employed by the reactor of the invention. FIG. 13(*a*) shows the yoke core 160 or 161; FIG. 13(*b*) shows a circular magnetic leg core 141; and FIG. 13(*c*) shows the zero-phase core. Referring to FIG. 13, this embodiment differs from Example 2 in that the magnetic leg core has a circular configuration and is centrally formed with a slit.

Specifically, the amorphous ribbon is wound into a cylinder which is cut along a line passing through the center. With the electric insulating paper inserted between the half cylinder bodies, the half cylinder bodies are bonded together to form the slit 143. The yoke core shown in FIG. 13(*a*) and the zero-phase core shown in FIG. 13(*c*) are the same as those of Example 2 and hence, the description thereof is dispensed with.

Figure 14:
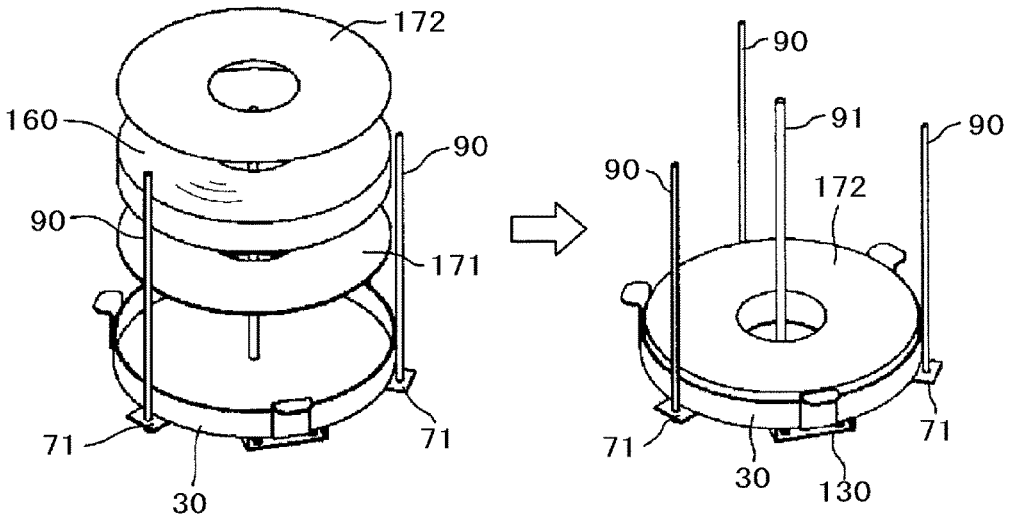
FIG. 14 is a group of perspective views showing a step of mounting the laminate and the yoke core to the bottom fastening fixture.

Next, the mounting of the lower yoke core is described with reference to FIG. 14. Referring to FIG. 14, three studs 90 are arranged on the outside circumference of the stud metal fixture 71 fixed to the bottom of the bottom fastening fixture 30. Further, the stud 91 is disposed at the center of the bottom fastening fixture 30. The studs are fixed in position by tightening down the locknuts. Subsequently, the laminate 171 having a hollow disk configuration is placed in the case of the bottom fastening fixture 30. Placed on the laminate 171 is the yoke core 160, on which the insulating material (insulating sheet) 172 is placed. The laminate 171 is a sheet formed of an epoxy resin material or the like. The case of the bottom fastening fixture 30 has a height equal to the height of the stack of the laminate 171, yoke core 160 and insulating material 172.

Figure 15:
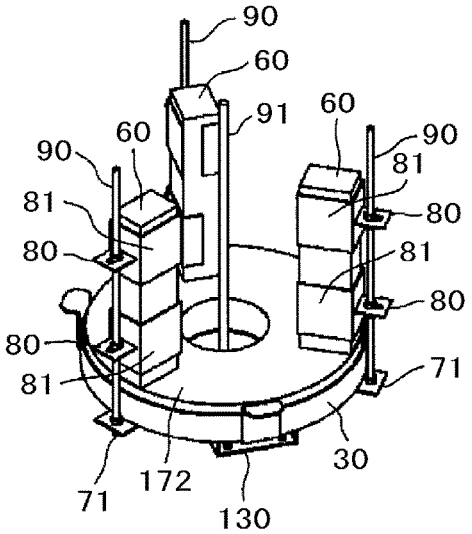
FIG. 15 is a perspective view showing a step of mounting the zero-phase cores to the bottom fastening fixture.

Next, the mounting of the zero-phase core 60 is described with reference to FIG. 15. Referring to FIG. 15, the three studs 90 arranged on the outside circumference of the bottom fastening fixture 30 are each mounted with two zero-phase core supports 80. The zero-phase core support 80 is connected to and integrated with the zero-phase core holder 81 formed of the rectangular metal frame body for receiving the zero-phase core 60 having the rectangular parallelepiped configuration. The zero-phase core 60 is inserted from above into this zero-phase core holder 81 of the metal frame and placed on the insulating sheet of the laminate 172. The rectangular metal frame of the zero-phase core holder 81 is formed with a cutout in a center-side face so as to facilitate the insertion of the zero-phase core 60.

Figure 16:
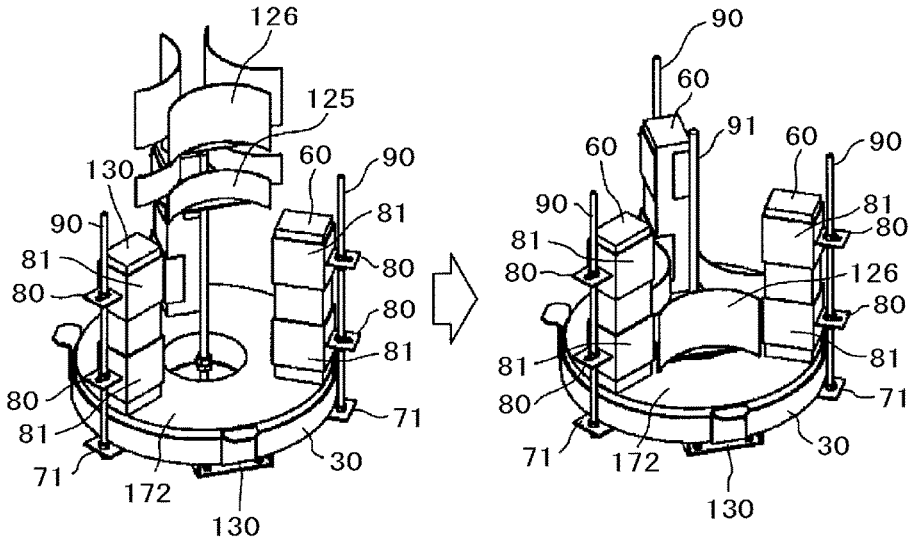
FIG. 16 is a group of perspective views showing a step of arranging coil support fixtures around a central stud.

Next, the mounting of the magnetic leg core and the coil is described with reference to FIG. 16. FIG. 16 is diagrams showing a structure where coil support fixtures and the insulating material are disposed at the center of the reactor device 10. In FIG. 16, a numeral 125 denotes a coil support fixture, a numeral 126 denoting the insulating material. The coil support fixture 125 has an arcuate configuration conforming to a circular configuration of a coil 101. Three coil support fixtures 125 are arranged about the central stud 91 with an equal angular spacing of 120° and between the zero-phase cores 60. The coil support fixtures 125 are fixed to the stud 91. The insulating material 126 is formed of an insulating sheet in an arcuate configuration conforming to the circular configuration of the coil 101. The insulating sheets are disposed on the outer side of the three coil support fixtures 125 for increasing insulation effect between adjoining coils 101. An insulating material such as silicone rubber is inserted in a gap between the coil support fixture 125 and the coil 101.

Figure 17:
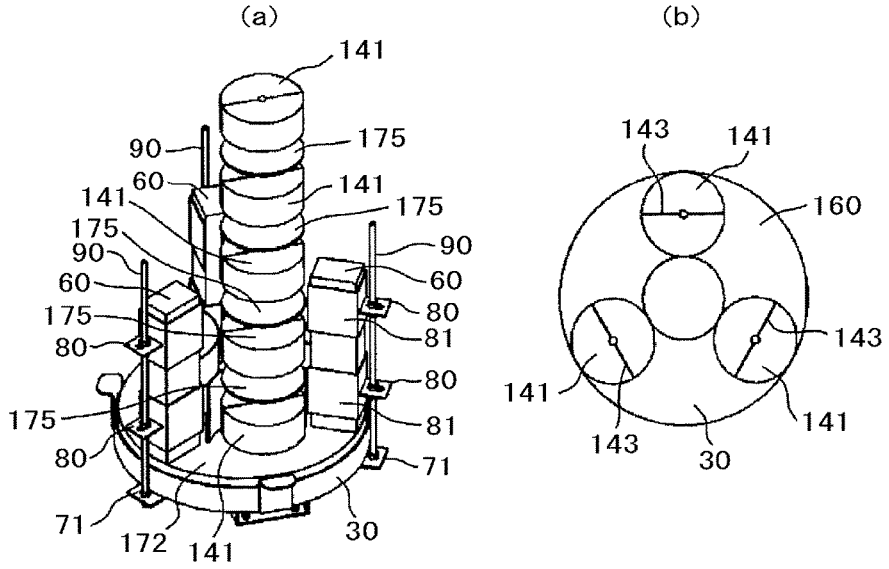
FIG. 17 is a group of perspective views showing a step of stacking and mounting circular magnetic leg cores.

Next, a method of assembling the circular magnetic leg cores 141 is described with reference to FIG. 17. In FIG. 17, FIG. 17(*a*) is a perspective view showing how the magnetic leg cores are assembled, while FIG. 17(*b*) is a diagram showing a layout relation of the yoke core 160 and the magnetic leg cores 141. Referring to FIG. 17(*a*), the magnetic leg cores 141 are disposed between respective pairs of zero-phase cores 60 and placed on the insulating material (insulating sheet) 172 on the yoke core 160. Subsequently, a laminate 175 is placed on the magnetic leg cores 141 and then, place on the laminate are the magnetic leg cores 141. This step is repeated to stack and assemble the magnetic leg cores 141. In the figure, five magnetic leg cores 141 are stacked.

As shown in FIG. 17(*b*), the layout relation of the magnetic leg cores 141 and the yoke core 160 is defined such that the sum of the diametrical length of the magnetic leg core 141 and the radius of the inner hole of the yoke core 160 is equal to the radius of the yoke core 160 and that the circular magnetic leg core 141 is circumscribed with the inner hole of the yoke core 160 and is inscribed in the outer circle of the yoke core 160. The line of the slit 143 formed in the magnetic leg core 141 is directed parallel to a winding direction of the yoke core 160 toroidally wound. That is, the line of the slit 143 of the magnetic leg core 141 is oriented in the direction of a tangent to the winding of the toroidally wound yoke core 160. Such a structure has an effect to reduce eddy-current loss. The inductance values (L value) of this reactor device 10 are adjusted by changing the thickness of the laminate 175 sandwiched between the magnetic leg cores 141, that is, the gap between the magnetic leg cores 141.

Figure 18:
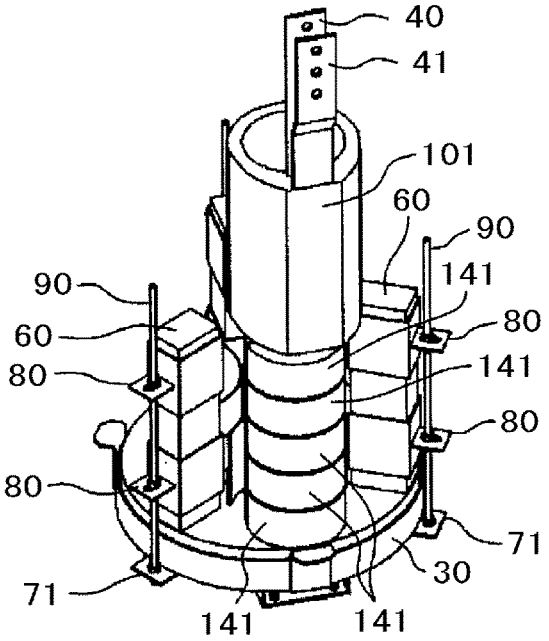
FIG. 18 is a perspective view showing a step of slidingly fitting the coil around the magnetic leg cores.

Next, a method of slidingly fitting the coil 101 around the stacked magnetic leg cores 141 is described with reference to FIG. 18. Referring to FIG. 18, the coil 101 is vertically slidingly fitted from above around the circular magnetic leg cores 141 stacked on the yoke core 160. A gap between the inside diameter of the coil 101 and the outside diameter of the magnetic leg core is adjusted to eliminate the backlash by inserting the insulating material in the gap. Of the terminals 40 and 41 of the coil 101, the inner coil terminal 40 is drawn from an inside periphery of the coil, while the outer coil terminal 41 is drawn from an outside periphery of the coil 101. The outer coil terminal 41 is formed with a step-like fold (one step) to increase a distance from the inner coil terminal 40.

Figure 19:
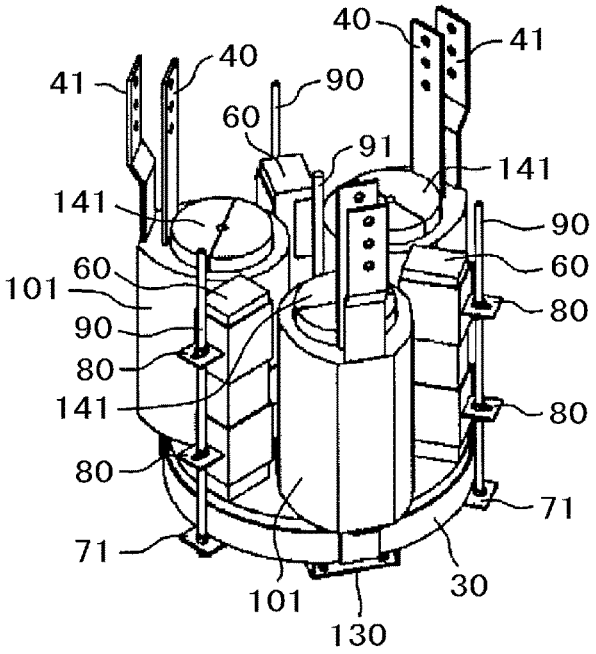
FIG. 19 is a perspective view showing a state where the coils are fitted around the three magnetic leg cores, respectively.

Next, FIG. 19 is a perspective view showing the three coils 101 fitted around the magnetic leg cores 141. FIG. 19 shows the magnetic leg cores 141 and coils 101 fixed in position by repeating the step of stacking the magnetic leg cores 141 shown in FIG. 17 and the step of slidingly fitting the coil 101 around the magnetic leg core 141 shown in FIG. 18. Referring to FIG. 19, the three zero-phase cores 60 and the magnetic leg cores 141 interposed therebetween are substantially equalized in height.

Figure 20:
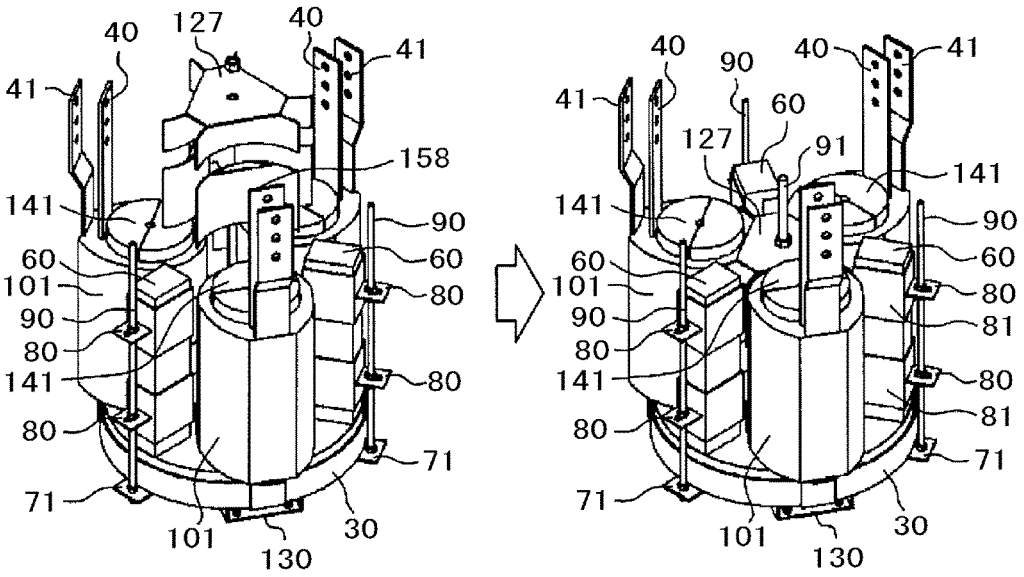
FIG. 20 is a group of perspective views showing a step of mounting the coil support fixture for fixing respective upper parts of the three coils.

Next, a method of fixing the coils 101 from above in the state where the magnetic leg cores 141 and the coils 101 are mounted is described with reference to FIG. 20. In FIG. 20, a numeral 158 denotes an insulating material while a numeral 127 denotes a coil support fixture. The insulating material 158 has an arcuate configuration conforming to the circular configuration of the coil 101 and is so formed as to cover the coil 101 thus offering an effect to gain the insulation distance between adjoining coils. The coil support fixture 127 is a substantially triangular metal plate, respective sides of which are vertically connected with a metal plate having an arcuate configuration conforming to the circular configuration of the coil 101. After the insulating material 158 is mounted, the coil support fixture 127 is inserted from above and mounted in position. Subsequently, the stud 91 is allowed to penetrate a hole formed at the center of the coil support fixture 127 and fixed in position by tightening down a locknut.

Figure 21:
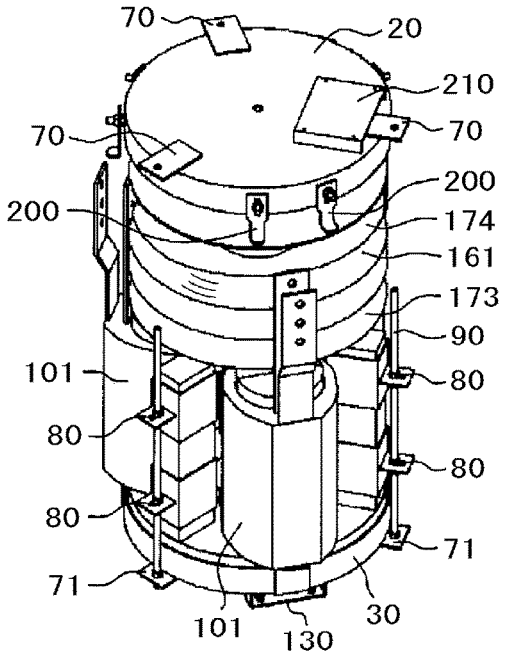
FIG. 21 is a perspective view showing a step of capping the laminate and the yoke core with the top fastening fixture.

Next, the mounting of the upper yoke core 161 is described with reference to FIG. 21. Referring to FIG. 21, the laminate 173 is placed on the assembled structure of the zero-phase cores 60, magnetic leg cores 141 and coils 101. Placed on the laminate 173 is the yoke core 161 and the laminate 174 is placed on the yoke core. Subsequently, these laminate 173, yoke core 161 and laminate 174 are capped with the case of the top fastening fixture 20. The stud metal fixtures 70 are fixedly welded to the outside circumference of a top side of the top fastening fixture 20.

Figure 22:
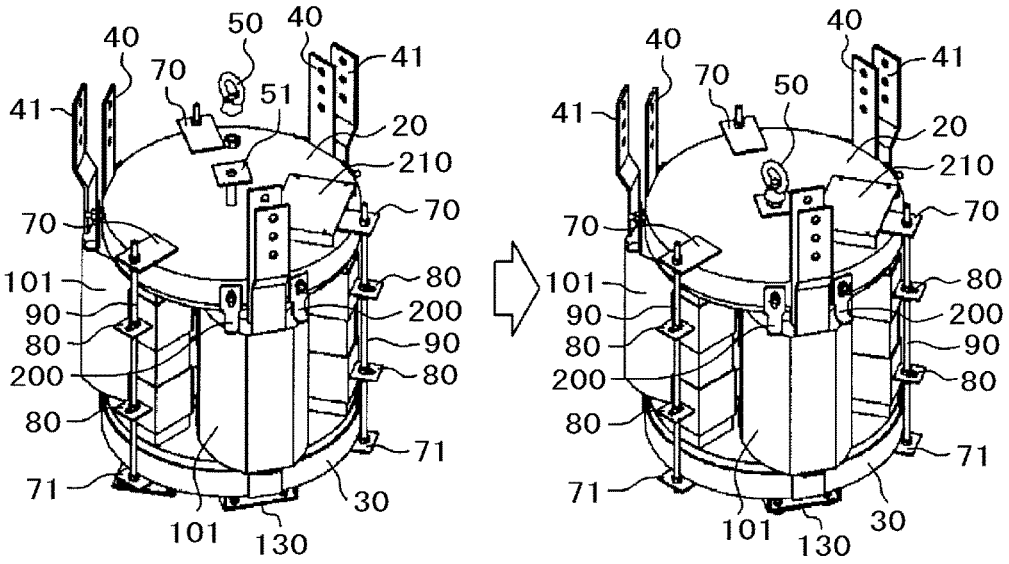
FIG. 22 is a group of perspective views showing a step of mounting the eyenut for hanging the reactor device.

Next, a method of fastening and fixing the individual iron cores and coils of the reactor device 10 is described with reference to FIG. 22. Referring to FIG. 22, the stud metal fixtures 70 arranged on the outside circumference of the top fastening fixture 20 are formed of a rectangular metal plate formed with a hole at a portion projected from the top fastening fixture 20. The stud metal fixtures 70 allow the three studs 90 to penetrate the holes thereof and to be fixed in position by tightening down the locknuts. The top fastening fixture 20 is centrally formed with the hole which is penetrated by the stud 91 to which the fastening fixture 51 is mounted. The top fastening fixture and the bottom fastening fixture 30 are fastened by tightening down the locknut on the fastening fixture 51 so as to fix the whole body of the reactor in position. The eyenut 50 for hanging the reactor body is mounted to the tip end of the stud 91. Each of the coils 101 is provided with two coil retainers 200 attached to the lateral side of the top fastening fixture 20 such that the coil is retained on the both sides of the coil terminals 40 and 41. A numeral 210 denotes a name plate showing a trade name, model code, product serial number, date of manufacture, manufacturer's name and the like of the device.

Figure 23:
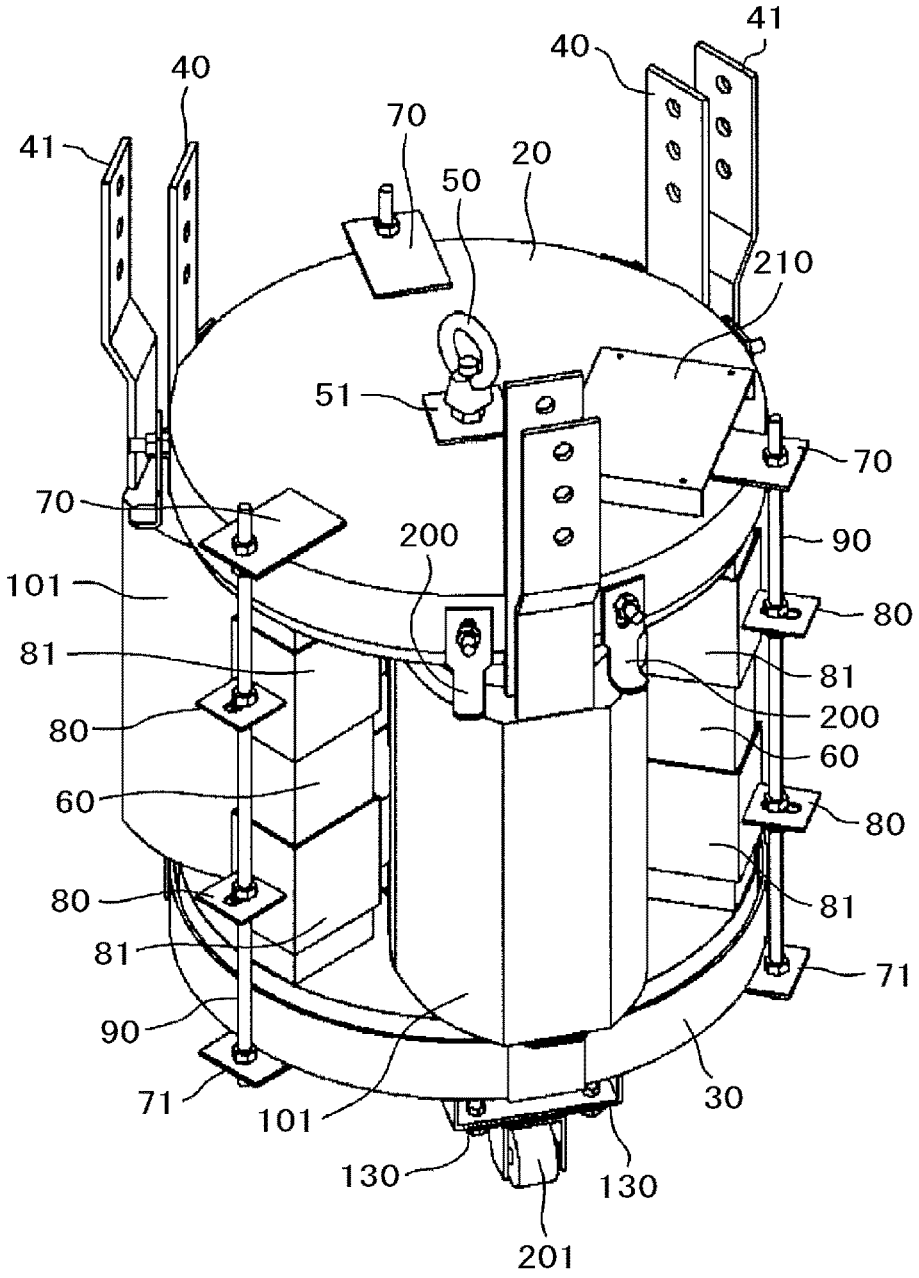
FIG. 23 is a perspective view showing a completed state where casters are attached to a base of the reactor device.

Next, a structure where a caster 201 is attached to a base 130 at the bottom of the reactor device 10 is shown in FIG. 23. Referring to FIG. 23, the caster 201 is attached to each of the U-shaped bases 130 disposed at three places on the circumference of the bottom of the bottom fastening fixture 30 with equal spacing so as to allow the reactor device 10 to move smoothly. Thus, the assembly work of the reactor device incorporating the circular magnetic leg cores 141 is completed.

Example 4

Figure 24:
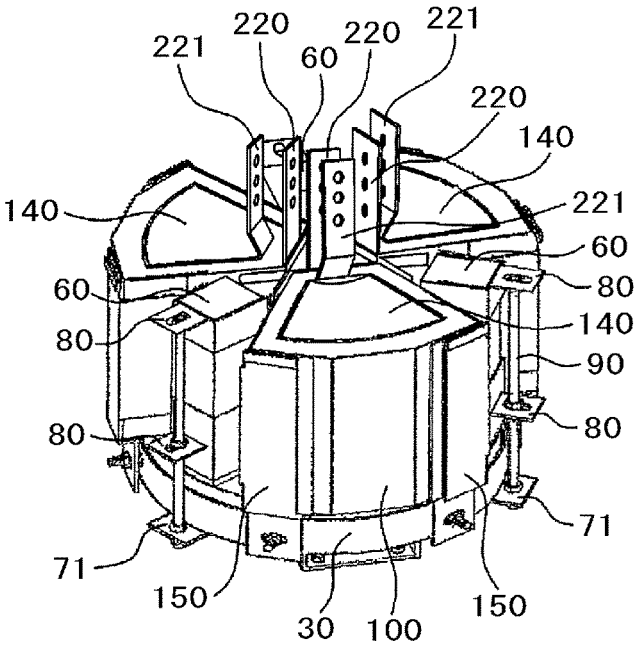
FIG. 24 is a perspective view showing a structure where coil terminals according to Example 4 are drawn from the inside of the reactor device.

Next, a structure where three pairs of coil terminals are drawn from the center of the reactor device according to the invention is described with reference to FIG. 24. FIG. 24 shows the structure where the coils 100 are arranged as slidingly fitted around the fan-like magnetic leg cores 140 while the zero-phase cores 60 are interposed between the coils 100. The figure is a perspective view showing coil terminals 220 and 221 drawn upward from the center of the reactor device. Referring to FIG. 24, the plate-like coil terminals 220 and 221 including holes are arranged on an inner side of each of the coils 100 fitted around each of the three magnetic leg cores 140 and connected to the winding start and the winding end of the coil. The central hole of the yoke core 161, which is not shown, is insulated so as not to make contact with the coil terminals 221. Further, the top fastening fixture 20 is centrally formed with a hole to allow the coil terminals 220 and 221 to project therethrough.

Example 5

Figure 25:
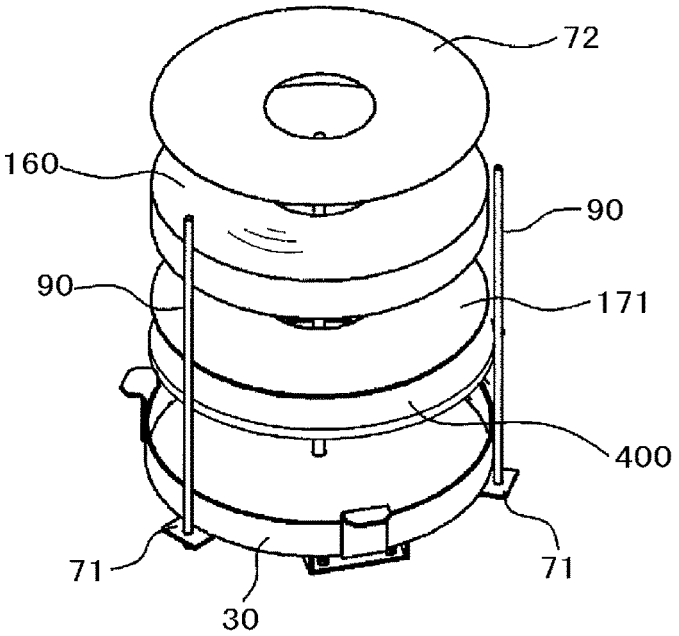
FIG. 25 is a perspective view showing a structure where a sound absorbing material is disposed between the top/bottom fastening fixture and the laminate.

Next, a structure where a sound absorbing material 400 is interposed between the top/bottom fastening fixture and the laminate is described with reference to FIG. 25. FIG. 25 is a perspective view showing the sound absorbing material 400 interposed between the bottom fastening fixture 30 and the laminate 171. Referring to FIG. 25, the sound is absorbed by sandwiching the yoke core 160 between the laminate 170 and the laminate 172 and interposing the sound absorbing material 400 between the lower laminate 170 and the bottom fastening fixture 30. The cause of the noises from the reactor device is an inverter incorporated in the power controller system. The inverter produces various frequency components in the electric power which oscillate the magnetic leg cores, yoke cores and the like, producing sounds. The sound absorbing material is used for absorbing these sounds. Examples of usable sound absorbing material include porous materials, namely fibrous glass wool including numerous micropores and sponge-like urethane.

While FIG. 25 shows the sound absorbing material 400 interposed between the laminate 170 and the bottom fastening fixture 30, an alternative arrangement may also be made such that the upper and lower laminates, the upper and lower yoke cores, the three magnetic leg cores and coils and the three zero-phase cores are wholly covered with the sound absorbing material.

Example 6

Figure 26A:
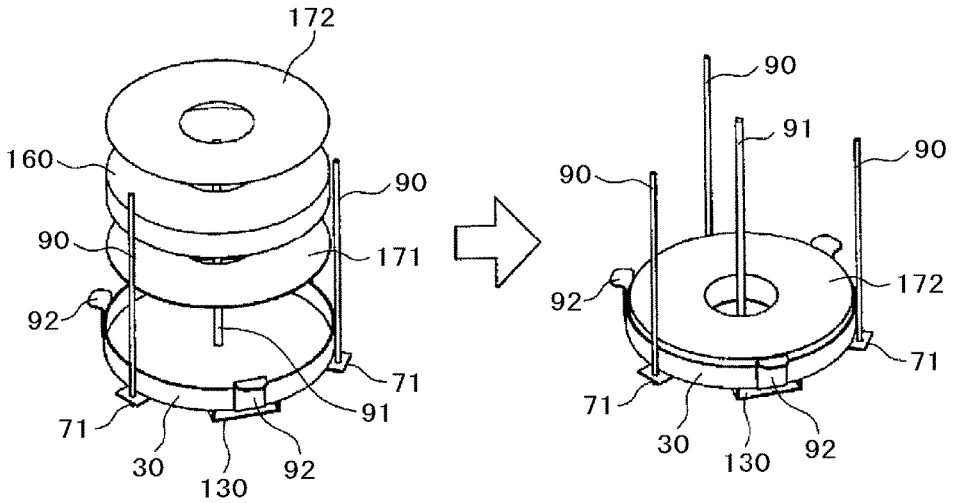
FIG. 26A is a group of perspective views showing a structure where a lower yoke core is mounted on the bottom fastening fixture.

Next, a method of assembling a device using the circular magnetic leg core is described. A significant difference from the circular magnetic leg core described in Example 3 is that the zero-phase core is not mounted. First, the mounting of the lower yoke core is described with reference to FIG. 26A. Referring to FIG. 26A, the studs 90 and 91 are vertically arranged on the bottom of the bottom fastening fixture 30 at one center position and at three outside peripheral positions of the circular case of the bottom fastening fixture 30. The three studs 90 on the outside circumference are arranged at an angular interval of 120° and positioned at the stud metal fixtures 71 fixed to the outside circumference. The central stud 91 is disposed at the center of the bottom fastening fixture 30 and fixed in position by tightening the locknut. In this state, the laminate 171 formed of a hollow disk-like silicone rubber or the like is placed in the case of the bottom fastening fixture 30. Placed on the laminate 171 is the toroidal yoke core 160, on which the hollow insulating material (insulating sheet) 172 is placed for insulating the magnetic leg core placed on the yoke core 160. The laminate 170 may employ a sheet formed from silicone rubber or epoxy resin. The case of the bottom fastening fixture 30 has a height substantially equal to a height of the stack of the laminate 171, the yoke core 160 and the insulating material 172.

Figure 26B:
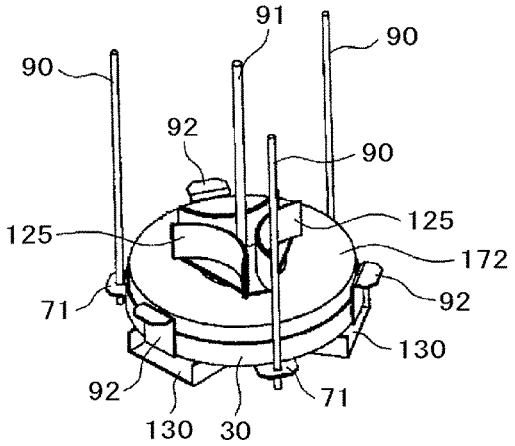
FIG. 26B is a perspective view showing a structure where the coil support fixtures and insulating materials are disposed at the center of the bottom fastening fixture.

Next, the mounting of the magnetic leg core and the coil is described. FIG. 26B shows a structure where the coil support fixture 125 and the insulating material are arranged at the center of the bottom fastening fixture 30. In FIG. 26B, the numeral 125 denotes the coil support fixture having a surface covered with the insulating material for insulating the coils from one another. The coil support fixture 125 has the arcuate configuration conforming to the configuration of the coil 101. The three coil support fixtures 125 are arranged about the central stud 91 with an equal angular spacing of 120° and fixed to the stud 91 or the laminate 172. The insulating material covering the coil support fixture 125 has the arcuate configuration conforming to that of the coil support fixture 125 such as to increase the insulation effect between adjoining coils 101. Silicone rubber or the like is used as the insulating material.

Figure 26C:
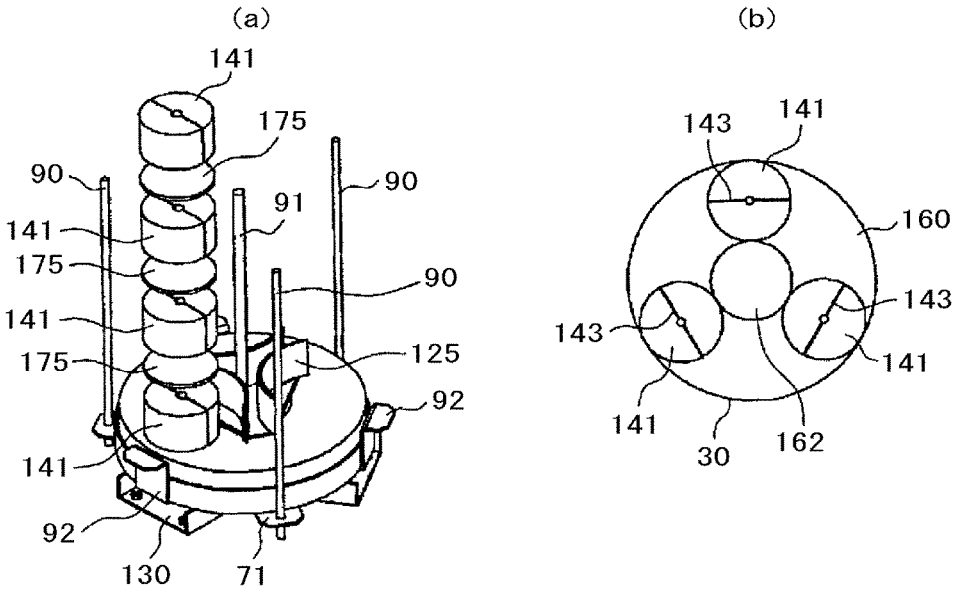
FIG. 26C(a) is a perspective view showing how cylindrical magnetic leg cores are assembled, and FIG. 26C(b) is a diagram illustrating a layout relation of the cylindrical magnetic leg cores and the yoke core.

Next, a method of assembling the magnetic leg cores having the circular cross section is described with reference to FIG. 26C. In FIG. 26C, FIG. 26C(a) is a perspective view showing how the cylindrical magnetic leg cores 141 are assembled and FIG. 26C(b) is a diagram showing a layout relation of the cylindrical magnetic leg cores and the yoke core. Referring to FIG. 26C(a), the cylindrical magnetic leg cores 141 are stacked on the insulating sheet 172 on the yoke core 160. The cylindrical magnetic leg cores 141 are stacked in four layers with the laminate 175 inserted between the individual magnetic leg cores 141. This structure is arranged at three positions with the angular spacing of 120° in correspondence to the coil support fixtures 125.

Referring to FIG. 26C(b), the layout relation of the cylindrical magnetic leg cores 141 and the yoke core 160 is defined such that the sum of the diametrical length of the magnetic leg core 141 and the radius of the inner hole 162 of the yoke core 160 is equal to the radius of the yoke core. The magnetic leg core 141 having the circular cross section is circumscribed with the inner hole 162 of the yoke core 160 and is inscribed in the outer circle of the yoke core 160. The line of the slit 143 formed in the magnetic leg core 141 is directed parallel to the winding direction of the yoke core 160 toroidally wound. That is, the line of the slit 143 of the magnetic leg core 141 is oriented in the direction of the tangent to the winding of the toroidally wound yoke core 160. Such a structure has the effect to reduce eddy-current loss. The inductance values (L value) of the reactor device are dependent on the thickness of the laminate 175 interposed between the magnetic leg cores 141, or the gap between the magnetic leg cores 141. The L values can be adjusted by changing this gap.

Figure 26D:
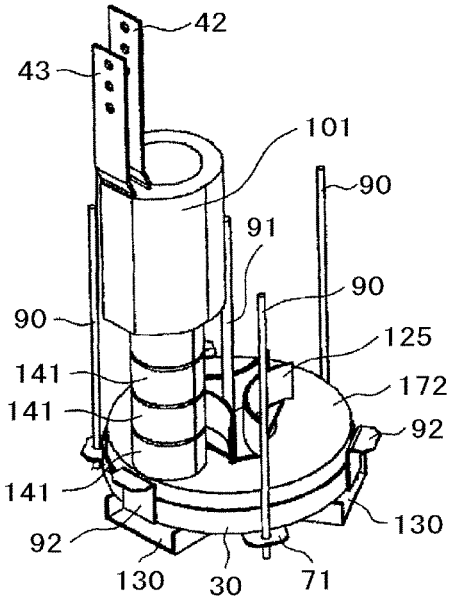
FIG. 26D is a perspective view showing a coil fitting step of slidingly fitting the coil around the stacked cylindrical magnetic leg cores.

Next, a method of slidingly fitting the coil around the stacked cylindrical magnetic leg cores 141 is described with reference to FIG. 26D. Referring to FIG. 26D, the coil 101 vertically approaches from above and is slidingly fitted around the magnetic leg cores 141 stacked on the yoke core 160 to reach the insulating plate 172 so as to be fixed in position. The insulating material is inserted in the gap between the inside periphery of the coil and the outside periphery of the magnetic leg core so as to adjust the gap to eliminate the backlash. Of terminals 42 and 43 of the coil 101, the inner coil terminal 42 is drawn from the inside periphery of the coil 101, while the outer coil terminal 43 is drawn from the outside periphery of the coil 101. Terminal portions projected from the coil are formed with a step to increase spacing therebetween. When the coil is slidingly fitted around the magnetic leg cores 141, the coil 101 is positioned as contacted against the coil support fixture 125. By doing so, the coils 101 can be precisely arranged with an equal angular spacing of 120°.

Figure 26E:
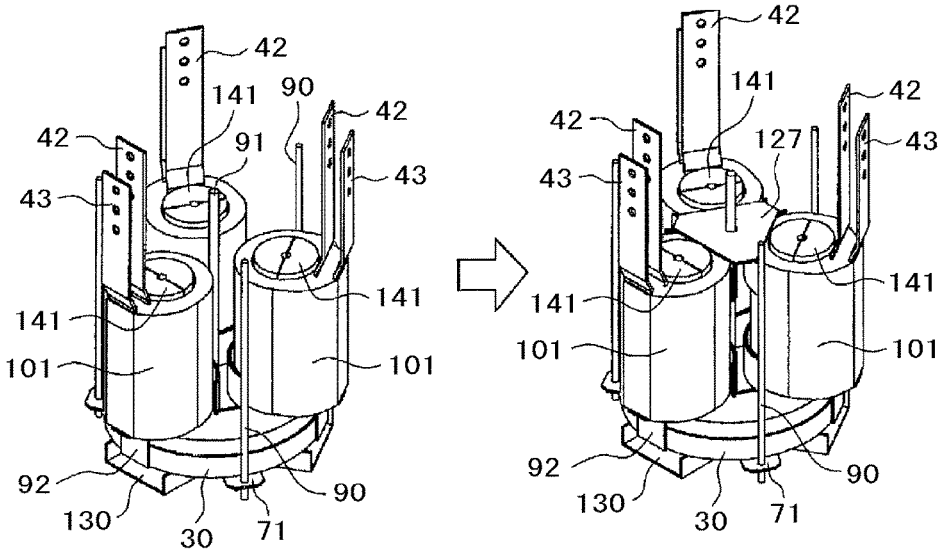
FIG. 26E is a group of perspective views showing a structure where a coil 101 is slidingly fitted around each of the three magnetic leg cores and a structure where the coils are fixed with the coil support fixture.

Next, a method of mounting three coils 101 on the respective circular magnetic leg cores 141 and fixing the coils with the coil support fixtures is described. FIG. 26E shows a structure where the coils 101 are slidingly fitted around the three magnetic leg cores 141 respectively and placed on coil support fixtures 92. The right-hand diagram shows a structure where the coils are fixed with the coil support fixture 127. With the coils 101 mounted on the three circular magnetic leg cores 141, the coil fixture 127 is disposed at the center. The coil fixture 127 is formed of a triangular metal plate and is centrally formed with a hole to allow the central stud 91 to penetrate therethrough. On a back side of the coil support fixture 127, arcuate members conforming to the outside configuration of the coil 101 similarly to the coil support fixture 127 are arranged with an equal angular spacing of 120°. The arcuate member is covered with the insulating sheet to enhance inter-coil insulation.

Figure 26F:
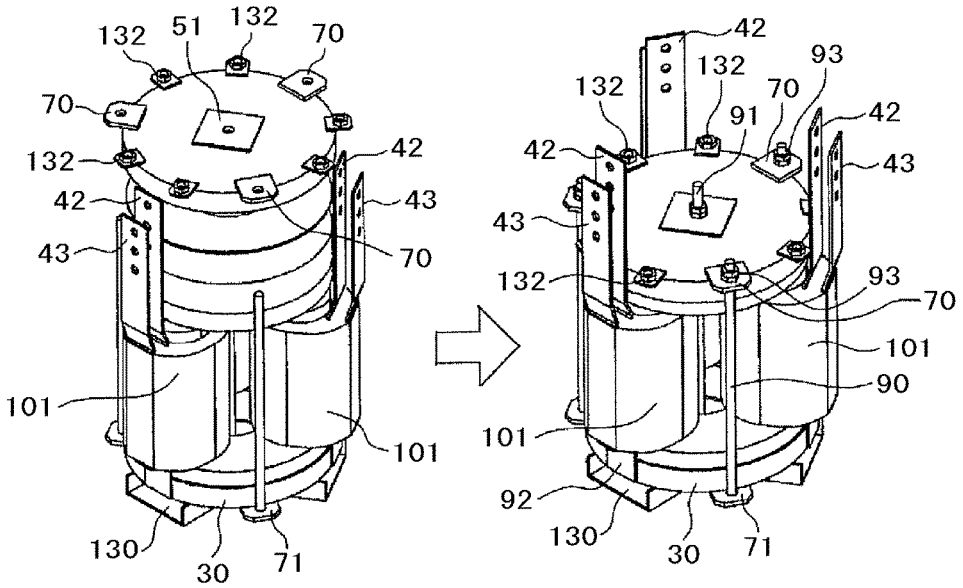
FIG. 26F is a group of perspective views showing a step of mounting an upper yoke core atop the coils.

Next, a method of mounting the upper yoke core atop the coils is described with reference to FIG. 26F. Referring to FIG. 26F, the laminate 173 is placed on the structure assembling the three magnetic leg cores 141 and the coils 101. Placed on the laminate is the yoke core 161, on which the laminate 174 is placed. Then, the laminate 173, the yoke core 161 thereon and the laminate 174 thereon are capped with the case of the top fastening fixture 20. Three stud metal fixtures 70 of the rectangular metal plate are arranged and fixed on the outside circumference of the top side of the top fastening fixture 20 at positions corresponding to the stud metal fixtures 71 arranged around the bottom fastening fixture 30 on the bottom side. Coil retainer holders 132 for receiving rod portions of coil retainers 134 for pressing and fixing the coils are arranged on the outside circumference of the top side of the top fastening fixture 20. The coil retainer holders are located on the both sides of the location of each terminal pair. The coil retainer holders are disposed at six locations in total. The stud metal fixture 70 of the rectangular metal plate is formed with the hole at the portion projected from the outside circumference of the top fastening fixture 20 and allows the stud 90 to penetrate this hole so as to be fastened and fixed in position by tightening a locknut 93 applied to the stud 90.

Similarly, the coil retainer holder 132 is also formed of a rectangular metal plate and formed with a hole at a portion projected from the outside circumference of the top fastening fixture 20 so as to allow a rod portion of the coil retainer 134 to penetrate therethrough. The coil retainer holder is fastened and fixed in position by tightening a locknut 133. The fastening fixture 51 formed of a rectangular metal plate is disposed at the center of the top fastening fixture 20. The fastening fixture 51 is centrally formed with a hole to allow the stud 91 to penetrate therethrough. After penetrated by the stud 91, the fastener 51 is fixed in position by tightening down a locknut 95. In this manner, the bottom fastening fixture 30 and the top fastening fixture 20 are fastened and fixed by means of the three studs 90 and the central stud 91. Therefore, the yoke cores, magnetic leg cores and coils sandwiched between the top and bottom fastening fixtures are rigidly fixed in position. Further, the coils are strongly fixed in position by means of the coil retainers 134.

Next, the eyenut 50 is mounted to the top of the central stud 91 through the top fastening fixture 20 so as to hang the reactor body. The coil retainer 134 is configured such that a tip end of a round rod thereof is shaped like a circle having a larger diameter than that of the rod portion, having an area large enough to press down a part of the coil. The coil retainer penetrates the coil retainer holder 132 and is driven by tightening the locknut 133 to press down the coil 101 against the bottom fastening fixture 30 and fix the same in position. The terminals 42 and 43 are each formed with a plurality of holes 45 to permit connection of power line.

Figure 26G:
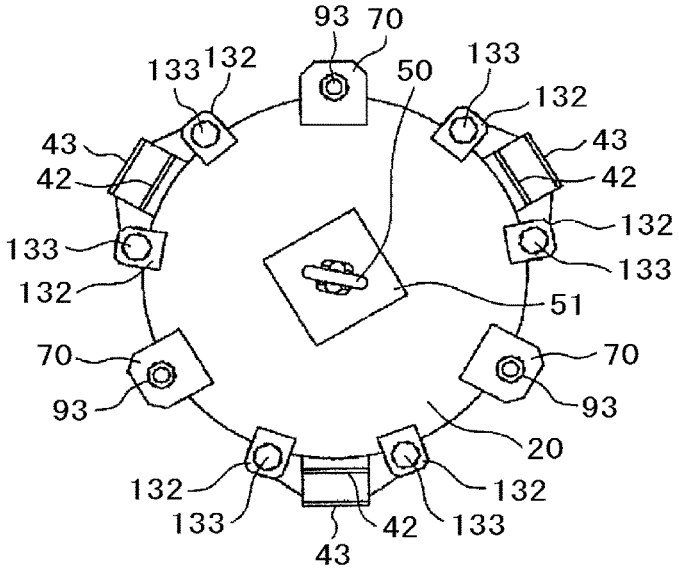
FIG. 26G is a top view showing the reactor device having all the components assembled thereto and equipped with the magnetic leg cores having a circular cross section.
Figure 26H:
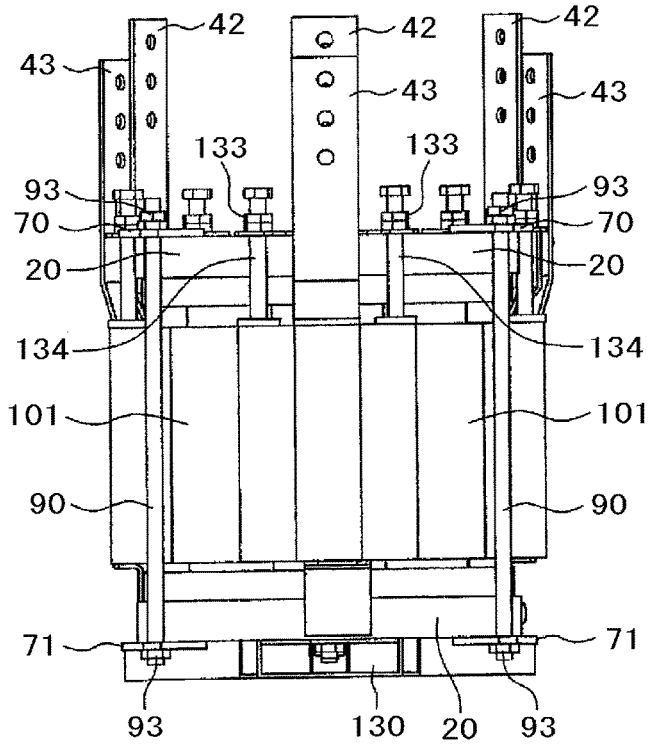
FIG. 26H is a front view showing the reactor device having all the components assembled thereto and equipped with the magnetic leg cores having the circular cross section.
Figure 26I:
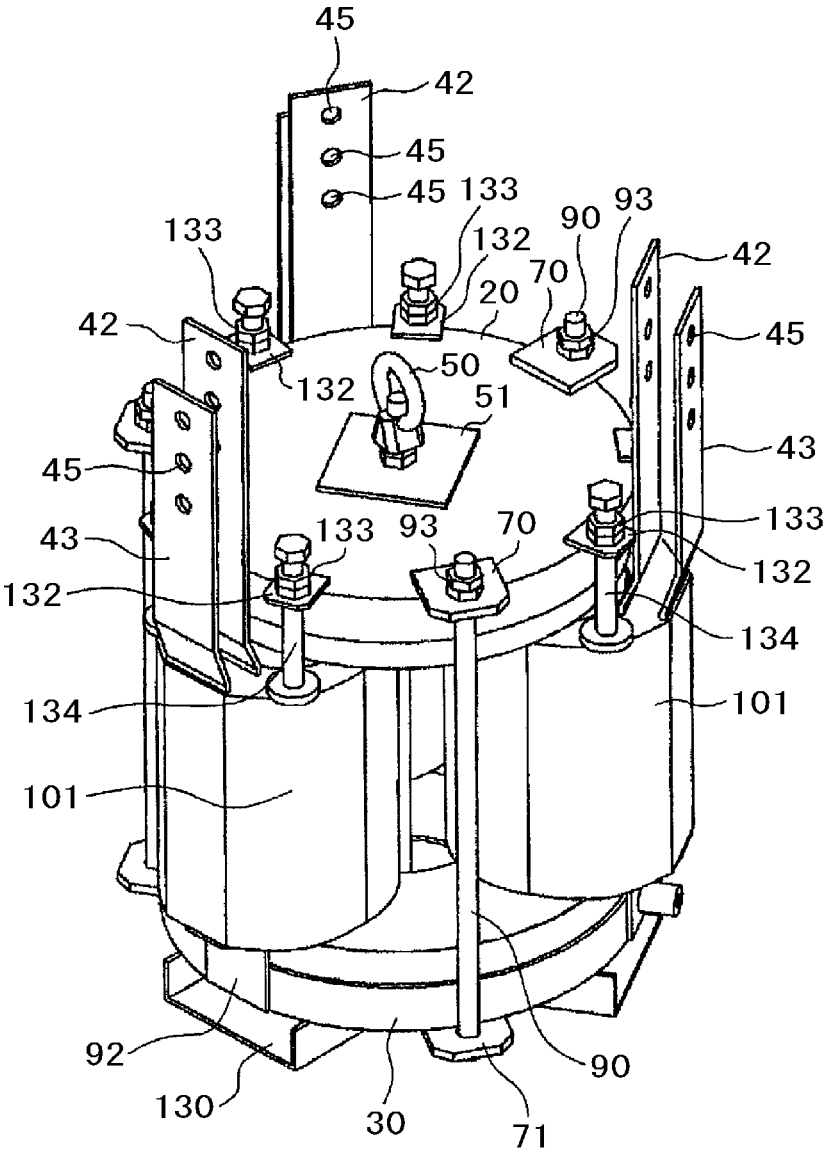
FIG. 26I is an external perspective view showing the reactor device having all the components assembled thereto and equipped with the magnetic leg cores having the circular cross section.

Next, FIG. 26I is an external perspective view showing the reactor device having all the components assembled thereto and incorporating the magnetic leg cores having the circular cross section. FIG. 26H is a front view of the device and FIG. 26G is a top view thereof. Referring to FIG. 26G, FIG. 26H, FIG. 26I, the coils 101 are placed on the coil support fixtures 92 arranged on the periphery of the bottom fastening fixture 30 and pressed down by the coil retainers 134 formed of a metal rod with the disk connected to the tip thereof. The opposite end of the metal rod is received by each of the coil retainer holders 132 arranged on the periphery of the top fastening fixture 20 and fixed in position by tightening the locknut 133. One coil 101 is fixed at two positions on the opposite sides of the terminal plates 42 and 43.

Example 7

Figure 27:
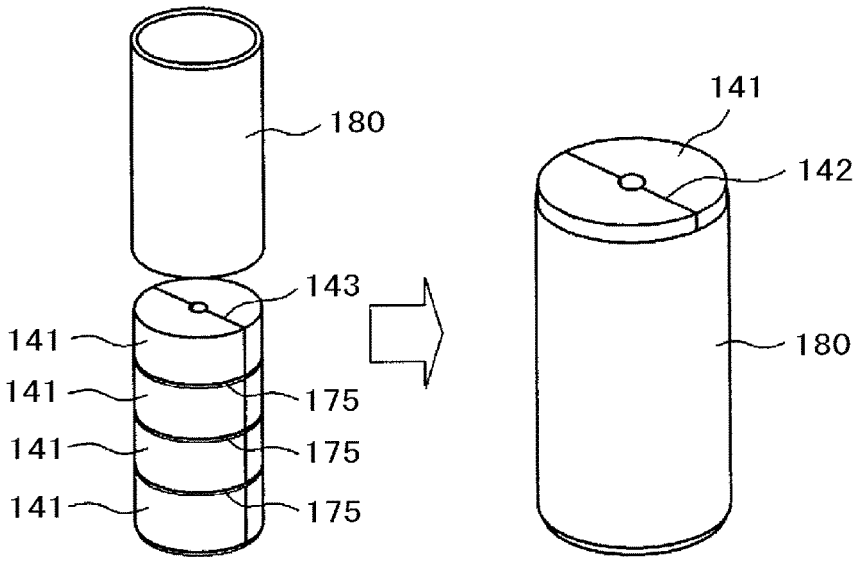
FIG. 27 is a group of perspective views showing a structure of the magnetic leg core where a stack of four magnetic leg cores having the circular cross section is assembled with an insulating tube body.

Next, description is made on a fixing method for magnetic leg core according to Example 7, which is different from the fixing method of Example 3. FIG. 27 is perspective views showing a structure of a magnetic leg core where an insulating tube body 180 is assembled from above by slidingly fitting the tube body around a stack of four magnetic leg cores 141 with the insulating laminate 175 interposed between the individual magnetic leg cores. The magnetic leg core is formed with the slit 143 and has the circular cross section. The three magnetic leg cores covered with the insulating tube body 180 shown in FIG. 27 are arranged on the yoke core 160 with an equal angular spacing of 120° and then the coils 101 are inserted therebetween as shown in FIG. 26E. An effect to prevent the deviation of individual magnetic leg cores 141 from a stacking direction is obtained by stacking the magnetic leg cores 141 having the circular cross section and covering the stack with the tube body 180. In the event of a deviation of the magnetic leg cores 141, increase in leakage flux and core loss results but can be obviated by the above structure.

Example 8

Figure 28:
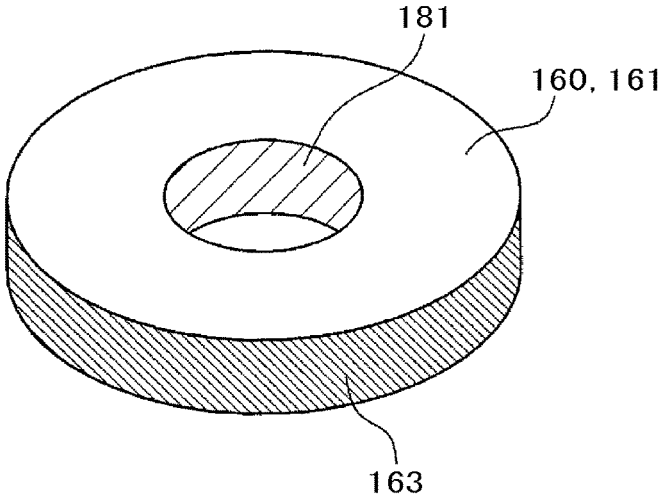
FIG. 28 is a perspective view showing a yoke core according to Example 8 of the invention.

A yoke core according to Example 8 is described with reference to FIG. 28. FIG. 28 is a perspective view showing the toroidal yoke core 160, 161 centrally formed with a circular hole. Referring to FIG. 28, the yoke core has an annular reinforcement metal plate 181 attached to a peripheral surface of the inner hole. This reinforcement metal plate 181 has a thickness of 2 mm or more. There is fear that the hole may be deformed in the circular configuration and subjected to core stress unless the central hole of the yoke core is reinforced on the inner side thereof. Under the core stress, the yoke core is increased in loss and deteriorated. The yoke core can be prevented from the deformation due to stress by reinforcing the inside periphery of the inner hole thereof.

In the yoke core of FIG. 28, an insulating material 163 is wound around the outermost peripheral surface of the yoke core 160 or 161. The insulating sheet is used as the insulating material 163 and wound around the outer periphery of the yoke core. Abnormal current between the yoke core and the top fastening fixture or the bottom fastening fixture is obviated by winding the insulating sheet 163 around the outer periphery or the lateral side of the yoke core 160 or 161 in this manner. The use of the insulating sheet is useful for gaining creepage distance between the yoke core and the top fastening fixture or bottom fastening fixture and reducing stray loss, thus preventing characteristic degradation. The insulating sheet also serves to eliminate the backlash between the yoke core and the top fastening fixture or bottom fastening fixture.

Example 9

Figure 29A:
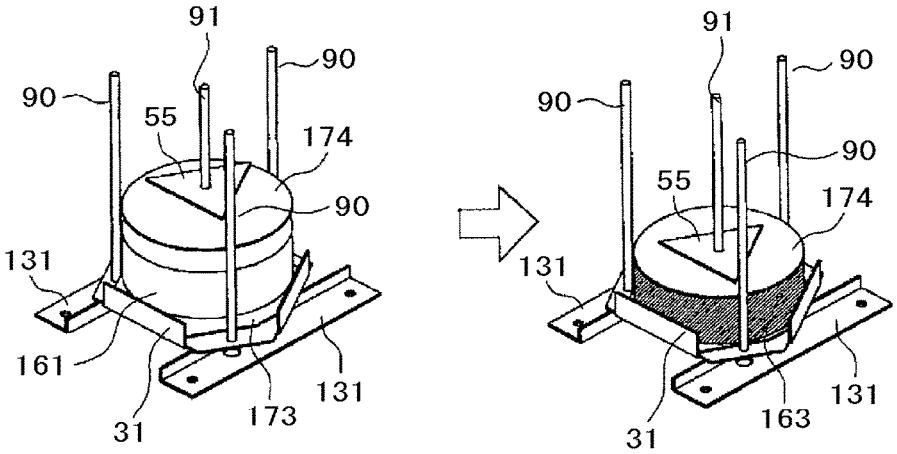
FIG. 29A is a group of perspective views showing a step of mounting the lower yoke core to the bottom fastening fixture according to Example 9 of the invention.

Next, a structure and assembly method of a reactor according to Example 9 of the invention is described with reference to related drawings. First, FIG. 29A is a group of assembly diagrams showing how to mount the lower yoke core. In FIG. 29A, a numeral 31 denotes the bottom fastening fixture; a numeral 131 denotes the base; the numerals 90 and 91 denote the stud; the numeral 173 denotes the laminate; the numeral 161 denotes the lower yoke core; the numeral 174 denotes the laminate; a numeral 55 denotes a magnetic-leg-core positioning laminate; and the numeral 163 denotes the insulating sheet wound around the yoke core 161.

The bottom fastening fixture 31 has a substantially hexagonal case configuration alternately formed with folding portions on sides thereof. The fixture has the stud 91 vertically erected from the center thereof and three studs 90 vertically erected not from the folding portions but from the center of each of the areas outside a location of the yoke core at an angular interval of 120°. The base 131 has an L-shape configuration for increasing strength. Two bases are arranged in juxtaposition with respective one sides of the L-shape welded to the bottom of the bottom fastening fixture 31, stabilizing the reactor device.

Figure 29B:
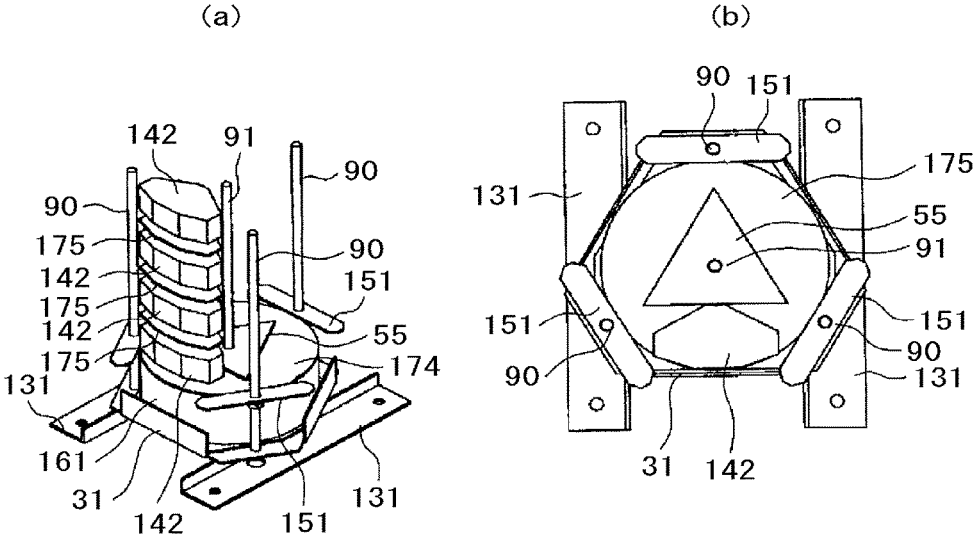
FIG. 29B(a) is an external perspective view showing a step of mounting the magnetic leg core and FIG. 29B(b) is a top view of the structure of FIG. 29B(a).

The bottom fastening fixture 31 and the two bases 131 have a positional relation, as shown in FIG. 29B(b). The bases 131 are arranged parallel to each other and perpendicular to two sides of the bottom fastening fixture 31. Placed on the bottom fastening fixture 31 is the laminate 173 of insulating sheet, on which the hollow, toroidal yoke core 161 is placed. Further, the laminate 174 is placed on the yoke core 161. Then, the core positioning laminate having an equilateral triangular shape is placed on the laminate 174. The core positioning laminate 55 includes a hole at the center (middle point) of the equilateral triangle to allow the central stud 91 to penetrate therethrough. As shown in FIG. 29B(b), the core positioning laminate is oriented in a manner that a perpendicular line drawn from one apex of the equilateral triangle is parallel to the longitudinal lines of the two bases fixed to the bottom fastening fixture 31. Further, the insulating sheet 163 is wound around the periphery of the yoke core 161 to eliminate the backlash.

Next, the mounting of the magnetic leg core is described with reference to FIG. 29B. In FIG. 29B, FIG. 29B(a) is an external perspective view showing a step of mounting the magnetic leg cores and FIG. 29B(b) is a top view of the structure of FIG. 29B(a). It is noted here that a magnetic leg core 142 has a substantially fan-like configuration as described in Example 1. Unlike Example 1, this magnetic leg core 142 is manufactured by stacking a core material cut into a strip shape having predetermined thickness and length. This magnetic leg core 142 is placed on the laminate 174 laid on the yoke core 161. A center part of the fan-like magnetic leg core 142 is cut off to define a flat part. As shown in FIG. 29B(b), the magnetic leg core is positioned with this flat part contacted against one side of the core positioning laminate having the equilateral triangular shape. The magnetic leg core can be positioned with high precision by placing the magnetic leg core in this manner. The opposite wing parts of the magnetic leg core 142 are cut off, while the arc of an arcuate portion is roughly trisected and the trisected arc parts are cut. Thus is formed the deformed magnetic leg core 142 having a substantially octagonal configuration.

Referring to FIG. 29B, the magnetic leg cores 142 are stacked in four layers with the laminate 175 interposed between the magnetic leg cores 142. While a step of mounting the coil is described hereinlater, a configuration of the magnetic leg core including the coil is dependent on the configuration of the core because the coil layer is so formed as to enclose the peripheries of the magnetic leg core. In the case where the magnetic leg core has the deformed fan shape substantially of octagon, therefore, the outermost shape of the magnetic leg core can be reduced and hence, the outermost shape of the coil can also be reduced. Accordingly, the reactor as a whole can be reduced in the final radial dimension. Such a reactor is advantageous in a case where restrictions are posed on installation location of the board or the like and on dimensions.

Referring to FIG. 29B, coil fasteners 151 are mounted to three studs 90 arranged on the outside circumference of the circular laminate 174.

The coil fastener 151 is an elongate metal plate centrally formed with a threaded hole so as to be threadably mounted to the stud 90. The coil fastener is fixed at a predetermined height or at a predetermined height position to support the coil by tightening a locknut applied to the back side of the coil fastener 151. The three coil fasteners 151 are substantially at the same height.

Figure 29C:
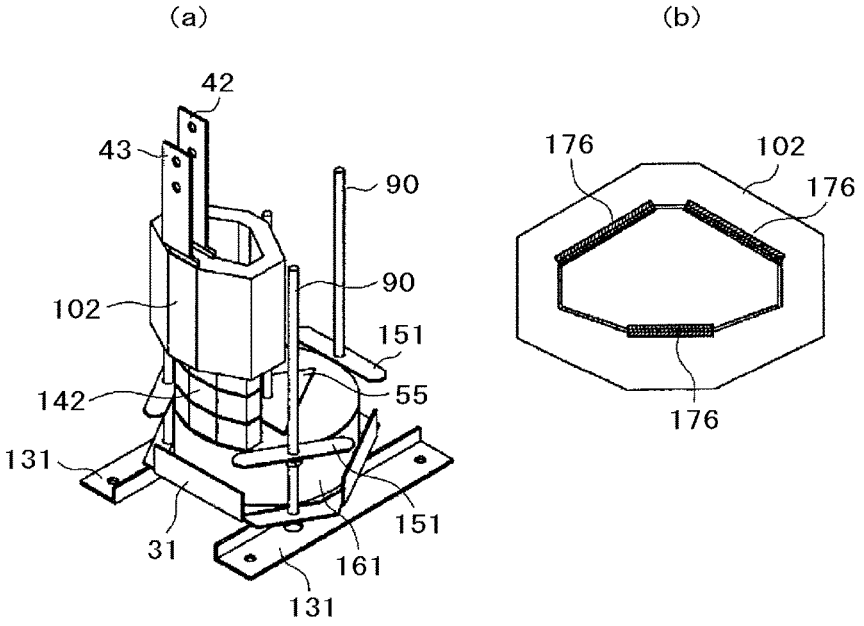
FIG. 29C(a) is an external perspective view of the coil being mounted and FIG. 29C(b) is a cross sectional view of the coil.

Next, a step of mounting the coil is described with reference to FIG. 29C. FIG. 29C(a) is an external perspective view showing how the coil is mounted, while FIG. 29C(b) is a sectional view of the coil. Referring to FIG. 29C(a), a coil 102 is vertically slidingly fitted from above around the magnetic leg cores 142 stacked in four layers. The coil 102 is provided with the terminals 42 and 43 at the top thereof for connection to the power line. As shown in FIG. 29C(b), an inner hole of the coil 102 has a configuration conforming to an outside configuration of the magnetic leg core 142 and is slightly larger than the core so as to permit insertion of the magnetic leg core. The coil 102 is provided with three insulating boards 176 at places on an inside periphery thereof so as to define a gap between the magnetic leg core 142 and the coil 102. In the case of backlash, the gap is adjusted by way of the insulating board 176 to eliminate the backlash.

Figure 29D:
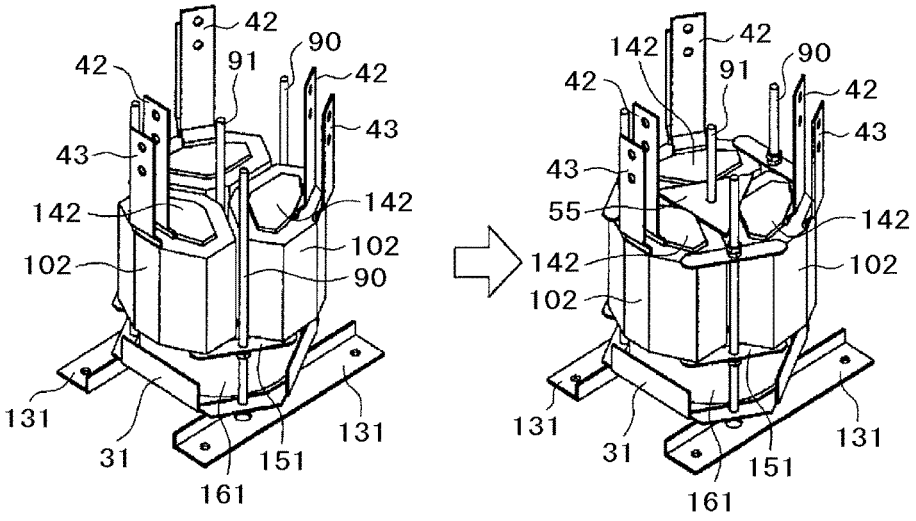
FIG. 29D is a group of external perspective views showing a process where three magnetic leg cores and coils are mounted by repeating the step of mounting one magnetic leg core and one coil shown in FIG. 29C(a).

Next, a step of mounting three magnetic leg cores and coils is described with reference to FIG. 29D. In FIG. 29D, an external perspective view shows the three magnetic leg cores and coils mounted by repeating the step of mounting one magnetic leg core and coil as shown in FIG. 29C(a). The right-hand diagram of FIG. 29D is a perspective view showing how the core positioning laminate 55 is mounted from above onto the mounted coils 102. A step of forming one magnetic leg core 142 by stacking iron cores in four layers with the laminates 175 interposed between the individual iron cores is performed for the other two legs. As shown in FIG. 29D, the step is performed for all the three legs to complete the mounting of the magnetic leg cores and coils.

In the state shown in FIG. 29D, the core positioning laminate 55 of the equilateral triangular shape is positioned by assembling the threaded hole at the center thereof with the stud 91 and adjusts the positions of the iron cores. It is noted here that the magnetic leg cores 142 have a slightly greater height than the coils 102. Referring to FIG. 29D, when the coil 102 is positioned with high precision, the coil fasteners 151 are threadably mounted on the studs 90 on the outside periphery and the coil 102 is fastened with the coil fasteners 151 on the bottom side and the coil fasteners 151 on the top side and fixed in position by tightening the locknuts on the fasteners. Each of the three coils 102 is fixed in this manner.

Figure 29E:
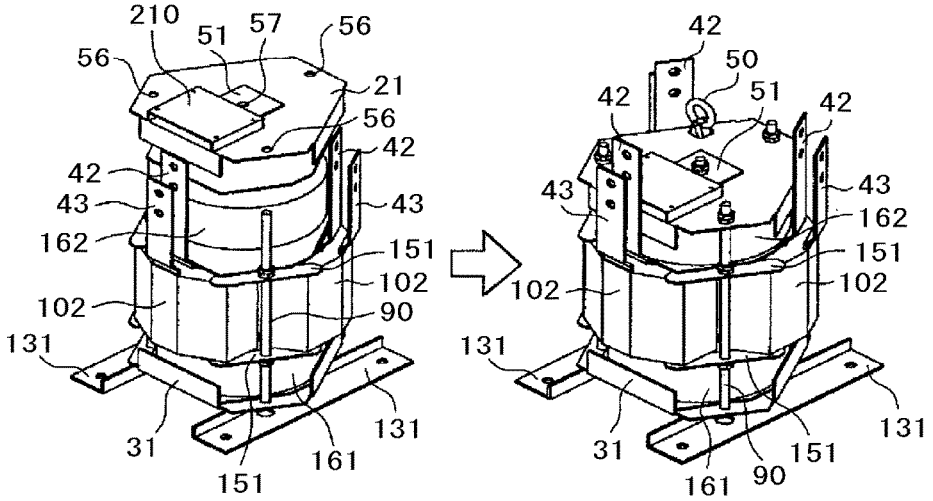
FIG. 29E is a group of external perspective views showing a step of mounting the yoke core atop the three coils and fixing these with the top fastening fixture.

Next, a step of mounting the yoke core on the coils 102 is described with reference to FIG. 29E. FIG. 29E is an external perspective view showing how the yoke core is placed on the three coils 102 and fixed in position with the top fastening fixture. Referring to FIG. 29E, a laminate 177 of a hollow disk shape is placed on the three coils 102 and a yoke core 162 is placed on this laminate. The yoke core 162 has the same circular configuration as that of the lower yoke core 161, or has the toroidal shape. A laminate 178 having a hollow disk shape is placed on the circular yoke core 162. The yoke core 162 is insulated from peripheral parts by winding the insulating sheet therearound. These laminates 177 and 178 and the yoke core 162 are capped with the case of the top fastening fixture 21. The stud 91 is penetrated through a hole 57 for the central stud 91, as located centrally of the top fastening fixture 21, while the studs 90 are penetrated through three stud holes 56 arranged on the circumference of the top fastening fixture 21. The magnetic leg cores, coils and yoke cores are fixed in position by tightening down the individual locknuts. The eyenut 50 is mounted to the tip end of the central stud 91 so as to hang the reactor device. The numeral 210 denotes the name plate showing the trade name, model code, product serial number, date of manufacture, manufacturer's name and the like of the device.

Figure 29F:
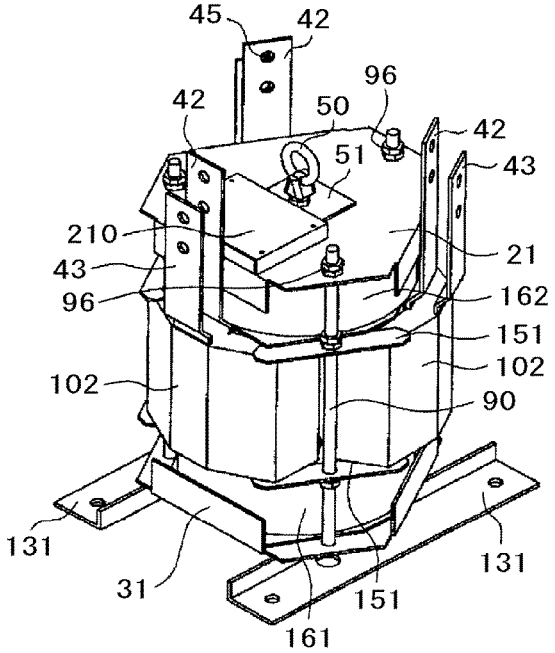
FIG. 29F is an external perspective view showing the reactor device having all the components assembled thereto and equipped with the magnetic leg cores having a fan-like cross section.
Figure 29G:
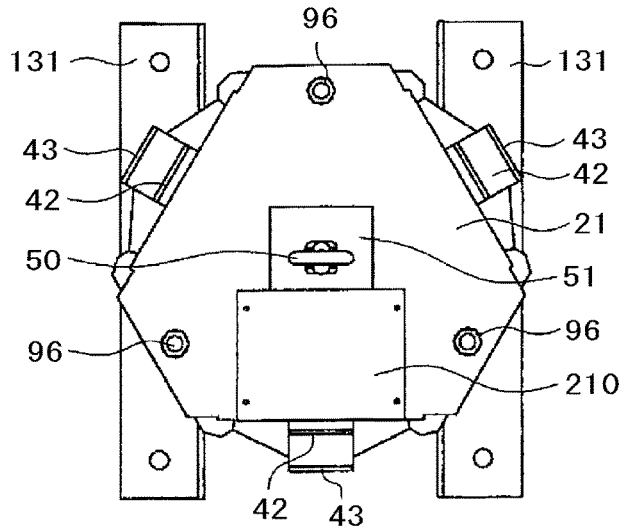
FIG. 29G is a top view of the device of FIG. 29F.
Figure 29H:
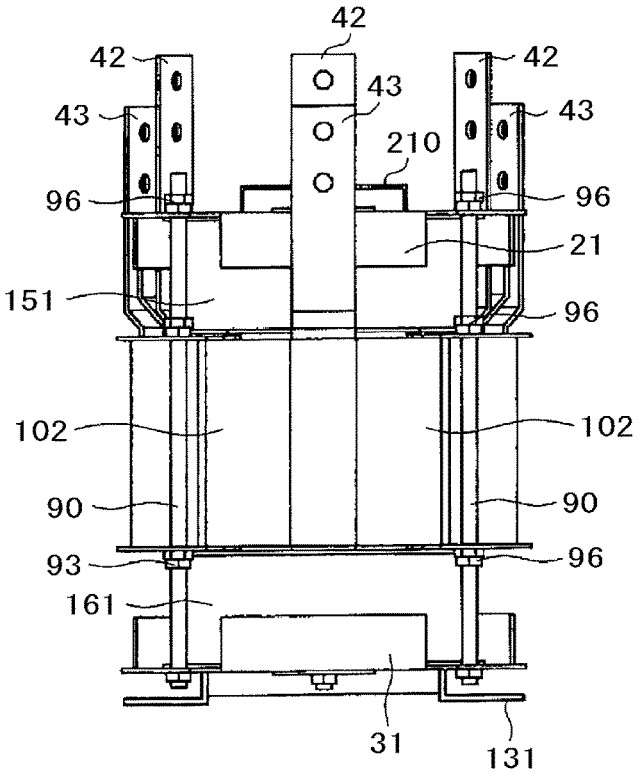
FIG. 29H is a front view of the device of FIG. 29F.

Next, FIG. 29F is an external perspective view sowing the reactor device having all the components assembled thereto and incorporating the magnetic leg cores having the fan-like cross section. FIG. 29H is a front view of the reactor device and FIG. 29G is a top view thereof. Referring to FIG. 29F, the two L-shaped bases 131 are fixed to the bottom fastening fixture 31 by welding or the like. The yoke core 161 and the laminate 174 are accommodated in the case of the bottom fastening fixture 31. The bottom fastening fixture 31 defines a deformed hexagon obtained by cutting an equilateral triangle on lines a predetermined length from the respective apexes, as shown in FIG. 29G. Specifically, FIG. 29G shows an outside configuration of the fixture having the deformed hexagonal shape obtained by cutting an equilateral triangle, one side of which is assumed to be 1, on respective lines about 0.26 away from each of the apexes. The stud 90 is disposed inside of each of the cut sides while the uncut sides are folded to accommodate the yoke core and the laminate. The bottom fastening fixture is so formed as to have the minimum area, achieving size reduction. The top fastening fixture also has the same configuration.

The coil 102 is disposed inwardly of the folded side and is so arranged as to position the magnetic leg core in the coil 102 in an overlapping relation with the yoke core. The terminals 42 and 43 are vertically drawn from the inner side and the outer side of the coil 102 to be connected to external terminals. The coil 102 is fixed in position by means of two coil fasteners 151 mounted on the stud 90 and clamping a part of the coil 102 therebetween, the fasteners clamped down by tightening upper and lower locknuts. The bottom fastening fixture 31 and the top fastening fixture 21 are driven to fasten and fix the yoke cores 161 and 162, the coils 102 and the magnetic leg cores 142 therebetween by tightening locknuts 96 mounted to the three studs 90 on the outside circumference and the one central stud 91.

Example 10

Figure 30:
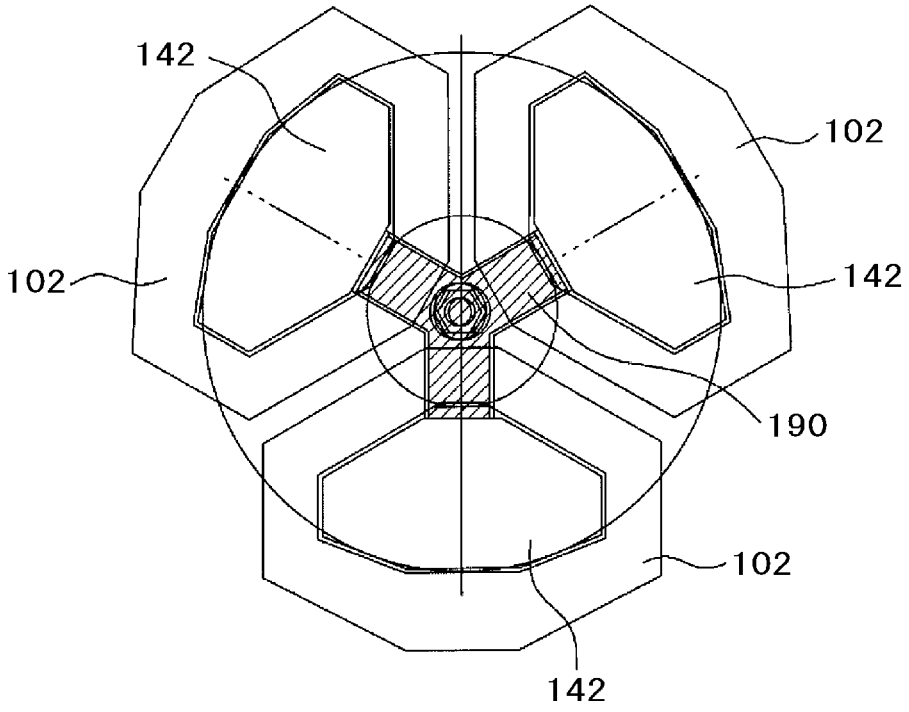
FIG. 30(*a*) is a plan view showing a case where the coil metal fixture is mounted and FIG. 30(*b*) is an external view of the coil metal fixture.
Figure 30:
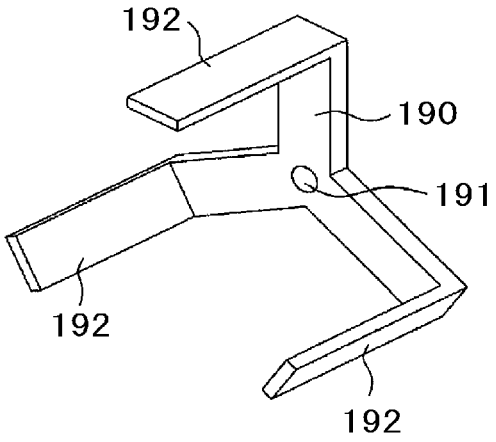

Next, a method of fixing the magnetic leg cores according to Example 10 of the invention is described with reference to FIG. 30. In FIG. 30, FIG. 30(*a*) is a plan view showing how a coil metal fixture 190 is mounted, while FIG. 30(*b*) is an external view of the coil metal fixture. As shown in FIG. 30(*b*), the coil metal fixture 190 is formed of a metal plate having a predetermined width which is radially extended from the center in three directions and folded on respective lines at a distance from the reactor center to a gap defined between the point at which the magnetic leg core 142 is closest to the reactor center and the point at which the inner hole of the coil 102 is closest to the reactor center. The extensions of the metal plate are each bent into an L-shape so as to form a claw 192 which is inserted in the gap between the magnetic leg core 142 and the coil 102 for fixing the components. The three directions define an equal angular spacing of 120° therebetween. The coil metal fixture 190 is centrally formed with a hole 191 to allow the fixture to be mounted on the stud 91 disposed at the center of the reactor.

FIG. 30(*a*) is the plan view showing how the coil metal fixture 190 shown in FIG. 30(*b*) and the coils 102 with the magnetic leg cores 142 mounted therein are arranged. The magnetic leg cores and coils are fixed in position by inserting the stud 91 in the central hole 191 of the coil metal fixture 190, inserting the projecting claws 192 of the coil metal fixture 190 in the respective gaps between the magnetic leg cores 142 and the coils 102, and fastening and fixing the magnetic leg cores and coils by tightening down the locknut on the stud 91. By providing the above structures employing the coil metal fixtures on the upper and lower sides of the coils 102 in this manner, the coils 102 can be prevented from radially deviating from the center. Because of contact with the coils 102 and the magnetic leg cores 142, the coil metal fixture 190 also has an effect to radiate heat from the coils 102 and the magnetic leg cores 142, contributing to the increase in the heat radiation effect of the reactor device as a whole.

Example 11

Figure 31:
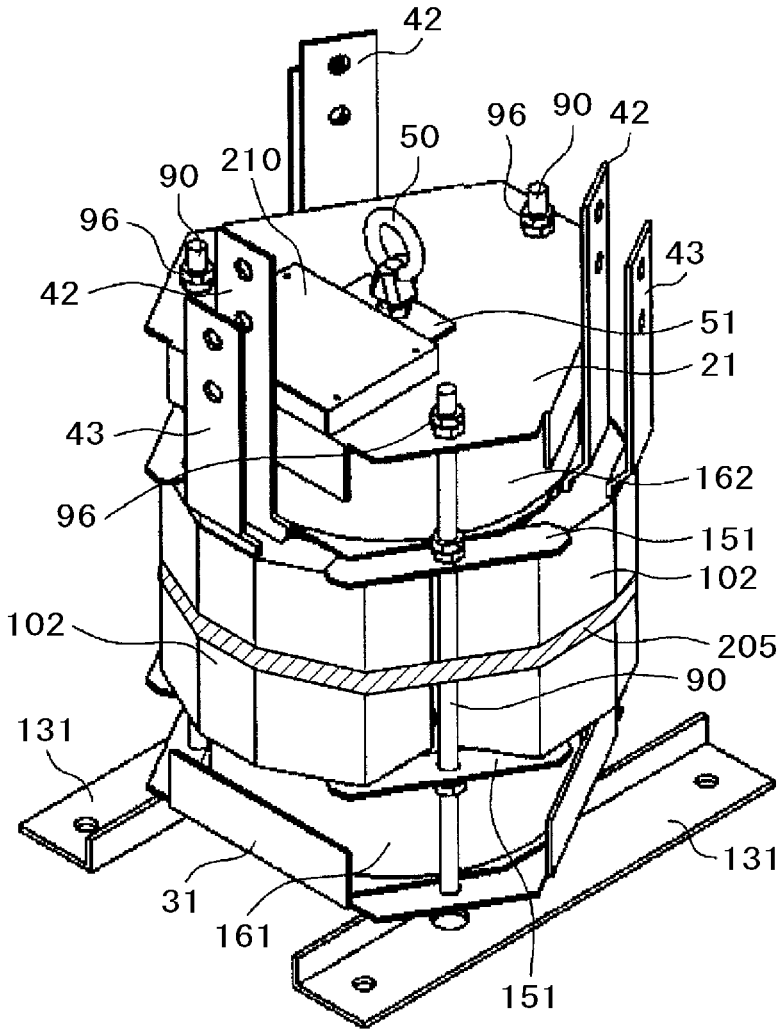
FIG. 31 is a perspective view showing a coil fixing method according to Example 11 of the invention.

Next, a coil fixing method according to Example 11 of the invention is described with reference to FIG. 31. Referring to FIG. 31, a band 205 is wound around the three coils 102 and the three studs 90 so that the coils 102 are fastened and fixed with the band 205. By fastening and fixing the coil part of the reactor device with the band 205 in this manner, the radial deviation of the three coils 102 from the center can be prevented. The winding mode of the band 205 is not limited to the single winding but the band can also be wound in double or more windings. The band 205 may employ a stainless sheet material, wire formed by twisting metal lines, and the like.

Example 12

Figure 32A:
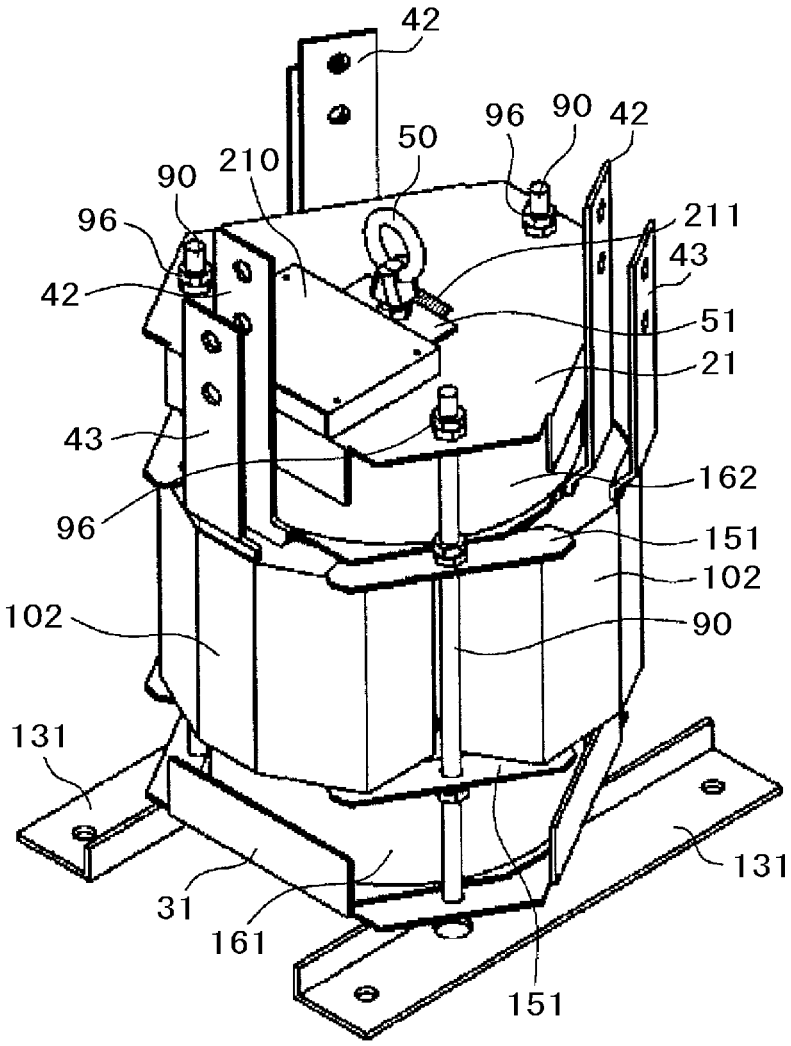
FIG. 32A is a perspective view showing a structure where a vent hole is disposed at the center of a top fastening fixture according to Example 12 of the invention.

Next, a cooling structure of the reactor device according to Example 12 of the invention is described with reference to FIG. 32A to FIG. 32C and FIG. 33. FIG. 32A shows the same structure of the reactor device as that shown in the external view of FIG. 29F, except that a vent hole 211 is disposed at the center of the top fastening fixture 21. In FIG. 32A, the description of the components common to those of FIG. 29F is dispensed with and the vent hole 211 as the different point is described.

Referring to FIG. 32A, the vent hole 211 is disposed near the center of the top fastening fixture 21 disposed atop the reactor device. The vent hole 211 is formed by a mesh or a punched hole and present in the area of the inner hole of the yoke core 162. If the vent hole 211 is similarly disposed near the center of the bottom fastening fixture 31 and in the area of the inner hole of the yoke core 161, the air flows through a central part of the reactor device from the bottom side toward the top side of the reactor device as shown in FIG. 32B, cooling the device by drawing heat from the magnetic leg cores 142 and the coils 102 and discharging the heat to the outside.

Figure 32B:
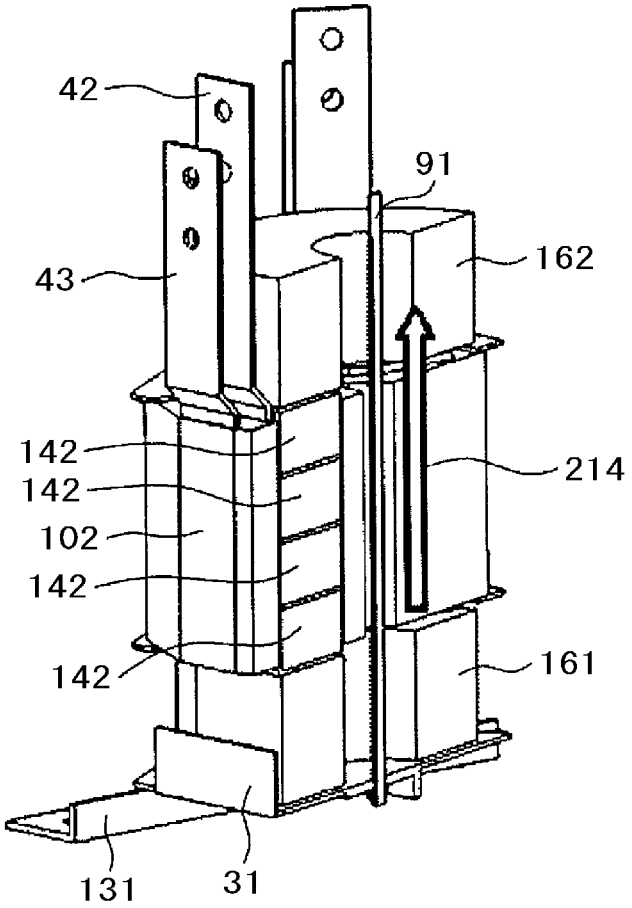
FIG. 32B is a vertical sectional view of the reactor device for illustrating an air flow.

FIG. 32B is a vertical sectional view of the central part of the reactor device 10. Referring to the figure, the numeral 91 denotes the central stud; the numeral 161 denotes the lower yoke core; the numeral 142 denotes the magnetic leg core; the numeral 102 denotes the coil; the numeral 162 denotes the upper yoke core; and a numeral 214 denotes an air flow. A structure of the reactor device of the invention includes space around the central stud 91. Therefore, if the vent hole 211 is arranged in a direction of the center axis of the bottom fastening fixture 31 at bottom and the top fastening fixture 21 at the top, the air 214 flows through the space at the center of the reactor device from the bottom side to the top side, cooling the magnetic leg cores 142 and the coils 102. Hence, heat is not accumulated within the device. The heat is radiated into the atmosphere because the coil part of the reactor device is exposed to the atmosphere at the outside periphery thereof.

Figure 32C:
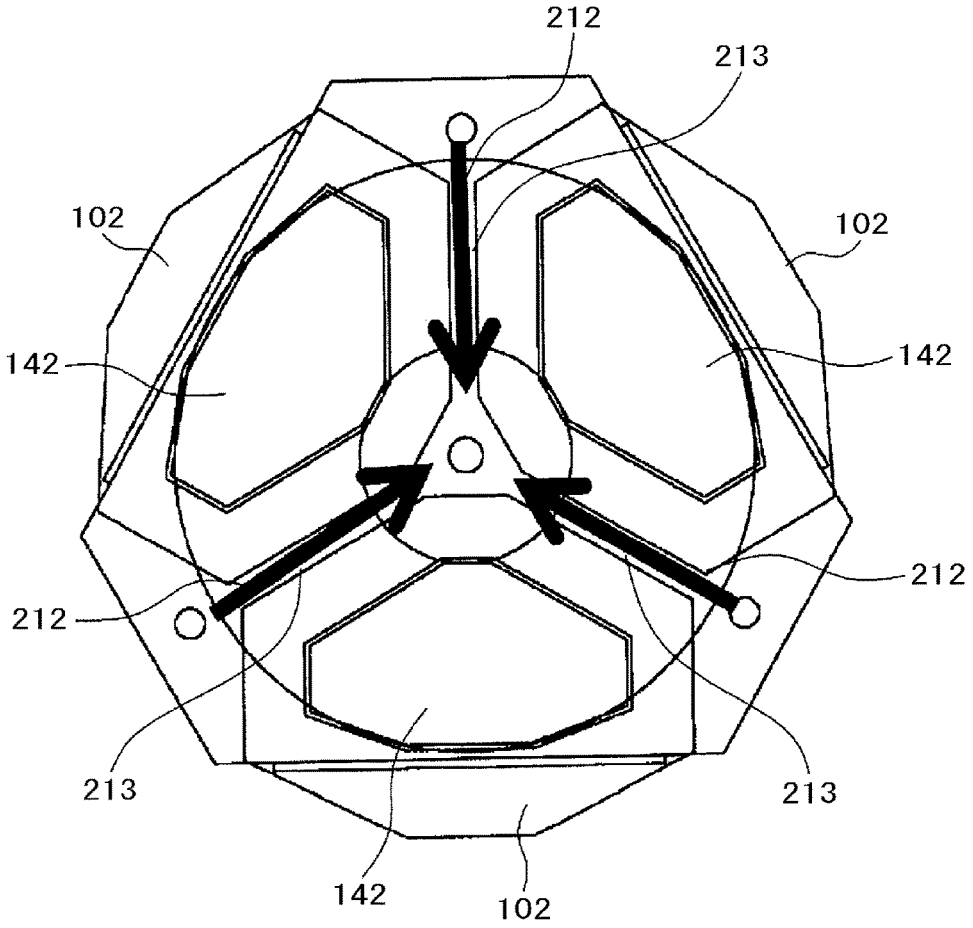
FIG. 32C is a horizontal sectional view of a coil part of the reactor device for illustrating the air flow.

FIG. 32C is a horizontal sectional view showing the coil part of the reactor device. Referring to FIG. 32C, a gap 213 is defined between adjoining coils 102. The reactor device is arranged to allow the air from the outside of the reactor device to flow to the center of the device through the gap 213 between the coils 102 (arrow 212) or to flow from the bottom side or the center of the reactor device to the top side and out of the device. Some air may flow out through the gap 213 between the coils 102. Such a structure shown in FIG. 32A to FIG. 32C is adapted to cool the coils 102 and the magnetic leg cores 142, increasing cooling efficiency. The magnetic leg core and yoke core employing the amorphous ribbon have small calorific values while the coil has a large calorific value. Hence, the cooling structure of the invention adapted to cool the peripheral area of the coil is effective.

Figure 33:
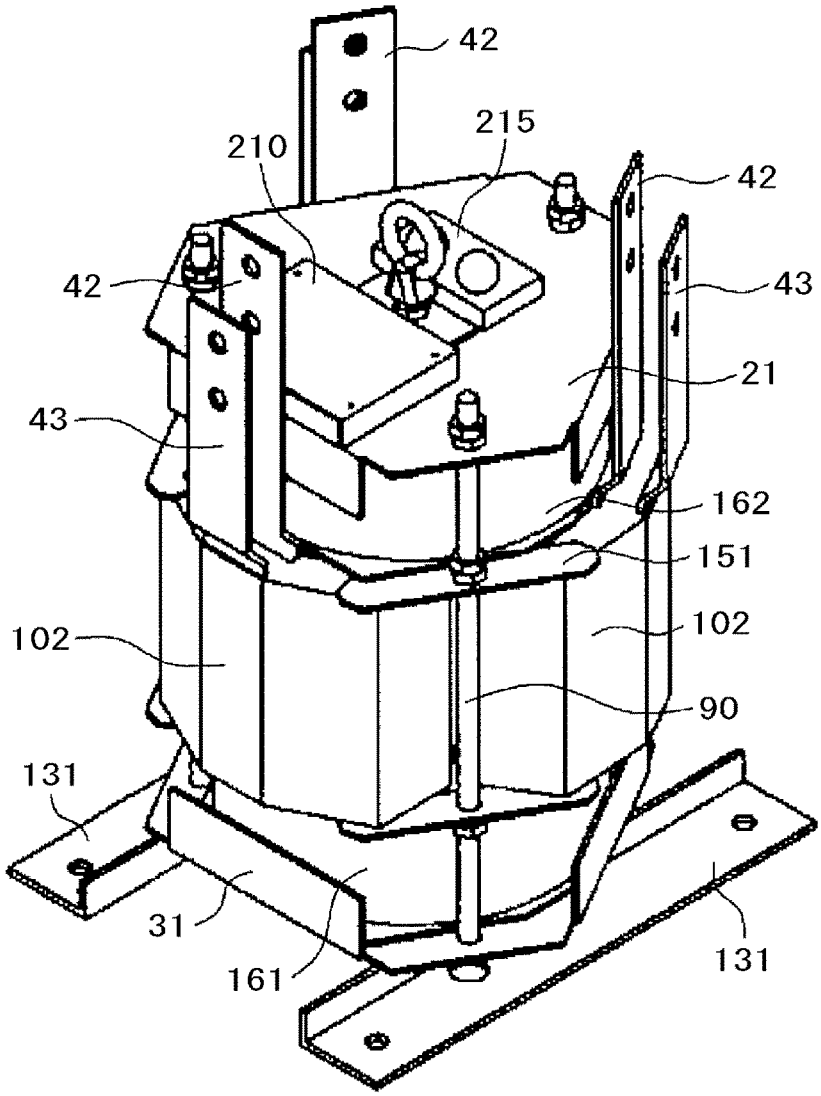
FIG. 33 is a perspective view of the reactor device where a fan is disposed at the center of the top fastening fixture of the reactor device.

Next, a cooling structure of the reactor device of the invention according to another system is shown in FIG. 33 and described. FIG. 33 is a perspective view of the reactor device where a fan 215 is disposed at the center of the top fastening fixture 21 at the top of the reactor device. Referring to FIG. 33, the cooling fan 215 is disposed above the vent hole 211 shown in FIG. 32A. This structure is arranged to install the fan 215 at the vent hole 211 near the center of the top fastening fixture 21 of the structure shown in FIG. 32A to FIG. 32C. Hence, the air is forcibly drawn in through the vent hole 211 at the center of the bottom fastening fixture 31 and the gaps 213 between the adjoining coils 102 and discharged from the center of the top fastening fixture 21, thus cooling the device. While FIG. 33 illustrates the fan 215 disposed at the center of the top fastening fixture 21 on the top side, the vent hole 211 at the center of the bottom fastening fixture 31 on the bottom side may also be provided with the fan for forcibly drawing in the outside air. The fan is exemplified by a propeller fan, turbofan and the like for forcing the air in one direction.

Example 13

Next, description is made on configurations of the magnetic leg core and coil and relation therebetween according to Example 13 of the invention. The reactor device is commonly installed in products such as distribution board and is often subjected to restrictions on overall dimensions and weight. In the iron cores produced at the same flux density, as the iron core is increase in mass, the iron core is also increased in core loss value. In the reactor device to which high frequencies are applied, the proportion of the core loss to the overall loss is significant and even a several percent loss is not negligible. For this reason, the increase in the total weight and volume of the reactor device must be reduced. What is most responsible for the weight and volume of the reactor device is the iron core and coil. In particular, the configuration of the three magnetic leg cores around which the coil is wound, or the cross-sectional area of the magnetic leg core is crucial.

Figure 34A:
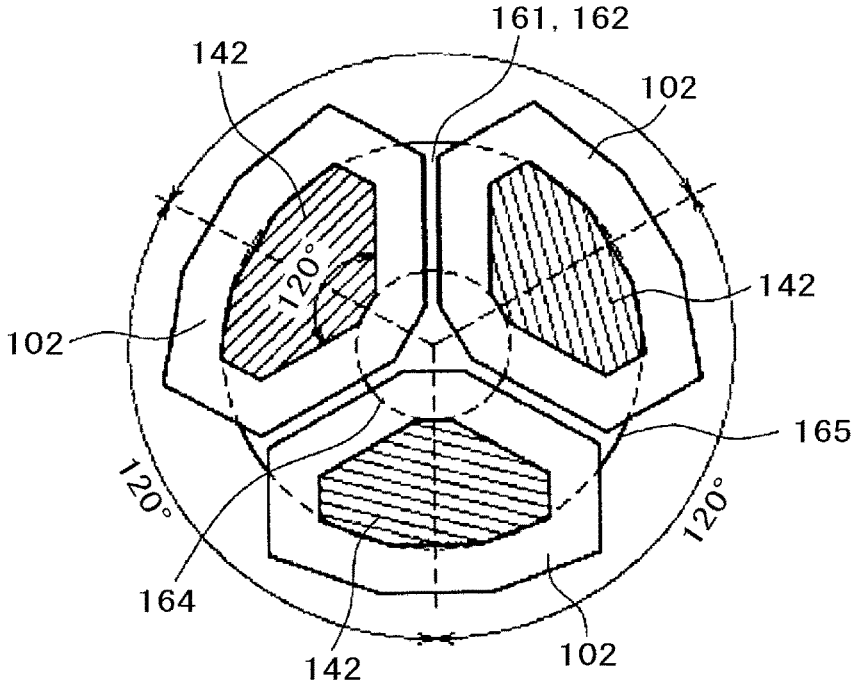
FIG. 34A is a plan view showing a layout of the magnetic leg cores, the coils and the yoke core.

FIG. 34A is a plan view showing a layout of the magnetic leg cores, coils and yoke core. Referring to FIG. 34A, in the case where the yoke cores 161 and 162 have the toroidal shape with the middle hole, the magnetic leg cores 142 of the same configuration are arranged with an equal angular spacing of 120° in order to equalize the three-phase inductance values. For size reduction of the cores maintaining equivalent core characteristics, the magnetic leg cores need to have a fixed cross-sectional area so as to equalize the density of magnetic flux flowing through the cores. It is noted here that the term "cross-sectional area" means the area of the overlap of the cross-sectional area of the magnetic leg core and the cross-sectional area of the end face of the yoke core in consideration of the fact that the magnetic flux flows in the yoke core.

Figure 34B:
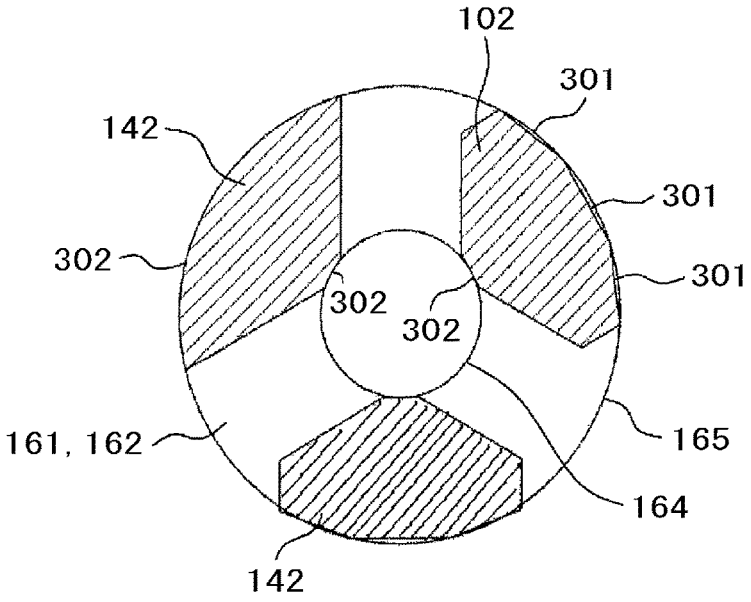
FIG. 34B is a diagram showing a positional relation of the fan-like magnetic leg cores and the yoke core.

FIG. 34A shows the configuration of the magnetic leg cores arranged at an angular interval of 120°±10° in order to prevent the increase in the cross-sectional area of the core. The magnetic leg core has an apex angle of 120°±10° on an inside peripheral side. Here, a portion of the magnetic leg core that is present inside of an inner circle 164 of the yoke core 161 or 162 is an unnecessary portion where the magnetic flux does not flow. Therefore, the unnecessary portion is chamfered along an arcuate line or linear line. FIG. 34B shows a positional relation between the magnetic leg core 142 and the yoke core 161 or 162. As for the upper-left fan-like magnetic leg core as seen in the figure, a fan-like outside periphery is chamfered along an arcuate line 302 while a fan-like apex (center) portion is chamfered along an arcuate line 302 conforming to the inner circle 164 of the yoke core because this portion is not overlapped with the yoke core 161 or 162 and thence is unnecessary. This arcuate portion may also be linearly chamfered. As for the upper-right magnetic leg core 142 in FIG. 34B, the outside periphery of the magnetic leg core 142 may be chamfered along chordal lines 301 conforming to an outer circle 165 of the yoke core 161 or 162. In this example, the arcuate line is chamfered along three chordal lines 301. Further, the opposite ends of the fan-like shape are cut off to eliminate acute-angled corners.

Figure 34C:
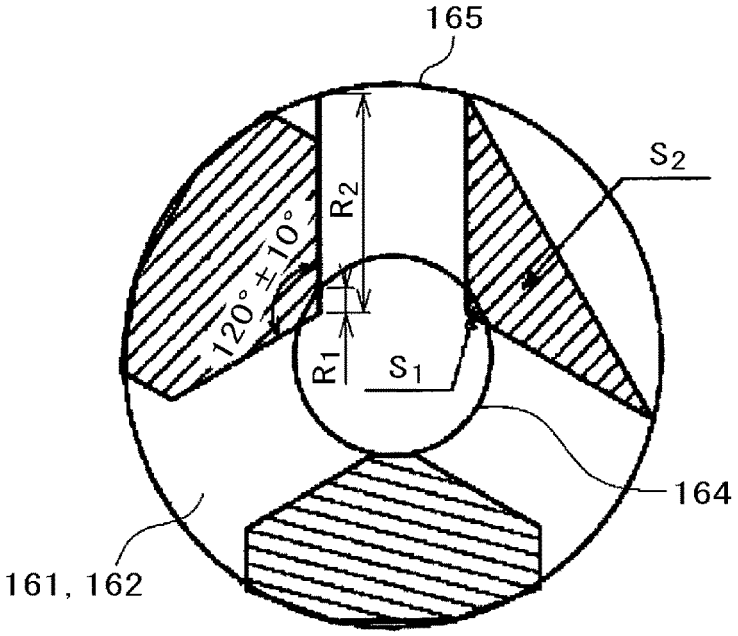
FIG. 34C is a diagram showing how the magnetic leg cores and the yoke core overlap with each other.

Next, the cross-sectional area of the magnetic leg core 142 is described. The minimum cross-sectional area as defined by the upper-right magnetic leg core 142 in FIG. 34C illustrates a case where an arcuate outside periphery of the fan shape defines one chord 301. Therefore, the magnetic leg core 142 need to have a cross-sectional area equal to or more than the above cross-sectional area. As for the upper-left magnetic leg core 142 in FIG. 34C, the following equation is obtained:

$$S_2 - S_1 = \frac{1}{2}R_2^2\sin 110° - R_1^2\pi \times \frac{110}{360} \approx 0.47R_2^2 - 0.96R_1^2 \quad (数1)$$

where the apex angle at the center of the fan shape is 120°±10°; R1 denotes the distance from the apex at the center of the fan shape to the inner circle 164 of the yoke core 161 or 162; R2 denotes the distance from the apex at the center of the fan shape to the outer circle 165 (outermost circle) of the yoke core 161 or 162; S1 denotes the cross-sectional area of a portion of the magnetic leg core 142 that is present inside of the inner circle 164 of the yoke core; and S2 denotes the cross-sectional area of the magnetic leg core 142 overlapped with the yoke core. The magnetic leg core may have a configuration represented by the area expressed as $S_2-S_1$. While the reactor device may sometimes be required of change in outside configuration depending upon the environment of installation site, the reactor device may adopt the above outside configuration so long as this configuration satisfies the required conditions of such a configuration having the minimum cross-sectional area. If the configuration of the magnetic leg core includes an acute angle, partial discharge occurs when powered up. Hence, a distance between the magnetic leg core 142 and the coil 102 is unduly increased, resulting in the increase of the weight and volume of the whole body of reactor. The increase of the weight and volume of the whole body of reactor can be controlled if all the apex angles are made 90° or more by chamfering the two outside peripheral apexes of the configuration represented by the area of $S_2-S_1$.

Figure 34D:
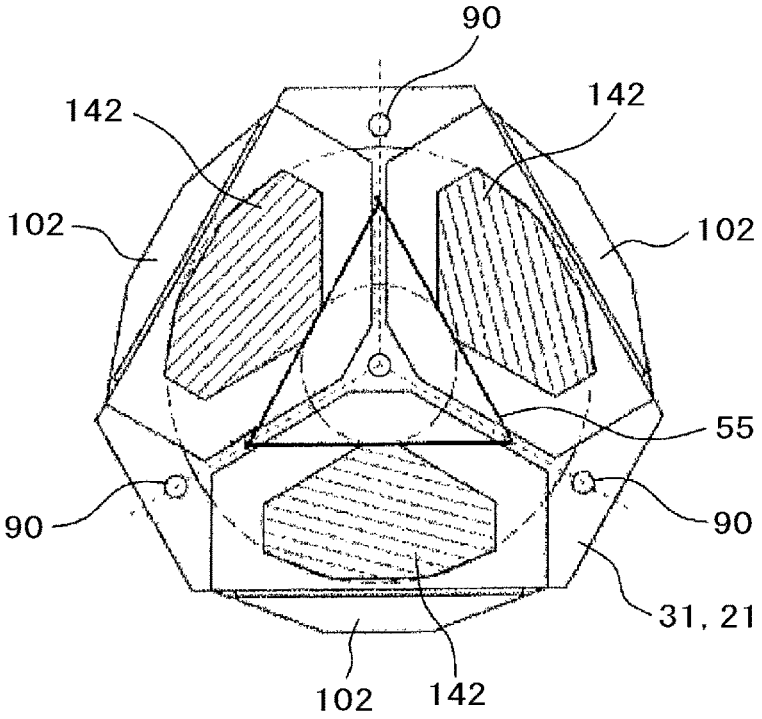
FIG. 34D is a diagram showing a layout relation of the magnetic leg cores, the coils and the bottom fastening fixture or the top fastening fixture, and the location of a core positioning laminate having an equilateral triangular shape.

The three magnetic leg cores 142 arranged at an angular interval of 120°±10° need be fastened with equal stress, as shown in FIG. 34D. For this reason, the studs 90 for fastening the magnetic leg cores are arranged about the yoke core at an angular interval of 120°±10° such that the magnetic leg cores, coils and yoke cores between the top fastening fixture 21 and the bottom fastening fixture 31 are fastened and fixed by means of the studs 90 and the stud 91.

Referring to FIG. 34D, the magnetic-leg-core positioning laminate 55 has an equilateral triangular shape and is formed with a hole for the stud 91 at the middle point of the equilateral triangle. The positioning laminate is so formed as to allow the arcuate portion or linear portion on the inner side of each of the three magnetic leg cores to be contacted against each side of the equilateral triangle, whereby the positioning laminate positions the magnetic leg cores with high precision.

Example 14

Figure 35A:
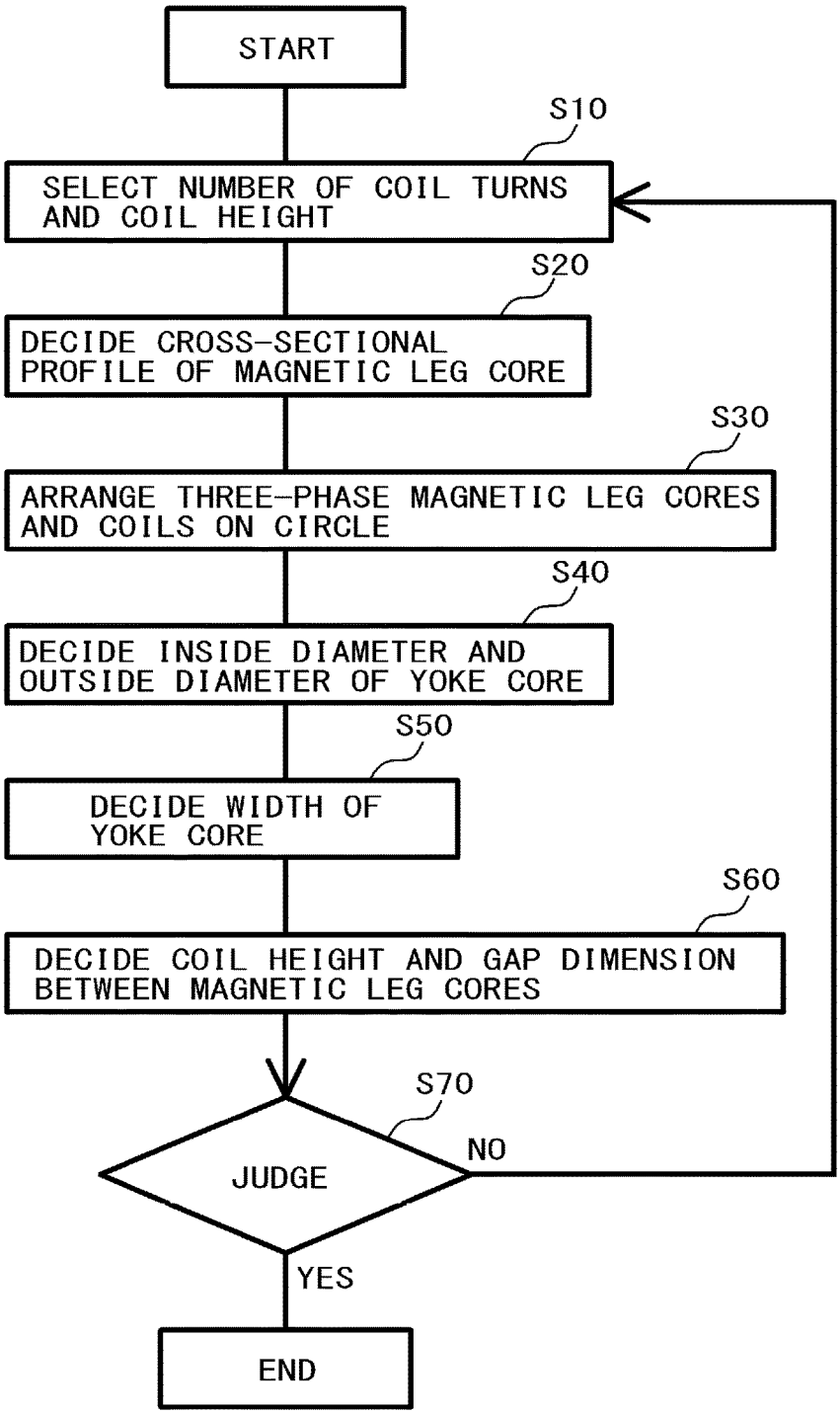
FIG. 35A is a flow chart showing the steps of setting dimensions of the magnetic leg core, coil and yoke core.
Figure 35B:
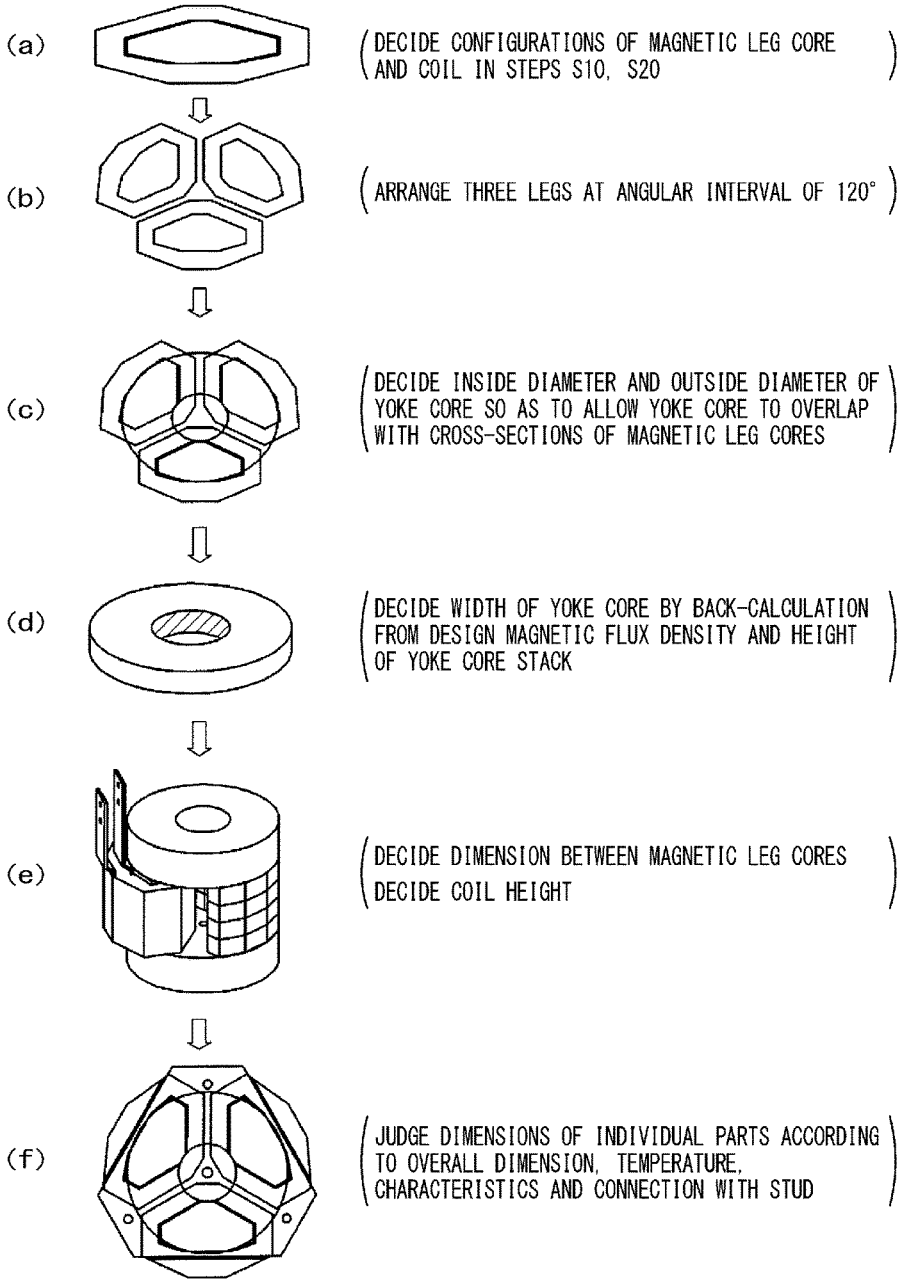
FIG. 35B is a group of partial views of the reactor device associated with the flow chart of FIG. 35A.

Next, settings of the magnetic leg core, coil and yoke core are described with reference to a flow chart shown in FIG. 35A and FIG. 35B. Referring to the flow chart of FIG. 35A, a thickness of a coil material and the number of coil turns are first decided so as to decide the thickness of the coil (S10). The thickness of the coil material is decided in consideration of the loss. The number of coil turns is decided in consideration of the inductance value. Next, the cross-sectional profile of the magnetic leg core is decided (S20). Specifically, the cross-sectional area is decided by back-calculation from the number of coil turns and the design magnetic flux density. The configuration of the magnetic leg core that is within the resultant cross-sectional area is decided. The configuration of the magnetic leg core may include fan shape, circle and the like and is decided based on the mass, the overall configuration and characteristics (FIG. 35B(a)). Next, the magnetic leg cores and coils for three phases are arranged on a circle with an equal angular spacing of 120° (S30) (FIG. 35B(b)). Next, the inside diameter of the inner hole of the yoke core and the outside diameter of the yoke core are decided (S40). The positional relation between the magnetic leg core and the coil is confirmed and the inside diameter of the hole in the yoke core and the outside diameter of the outermost circle thereof are so decided as to allow the magnetic leg cores overlap with the yoke core (FIG. 35B(c)). Next, the width of the yoke core is decided (S50). Specifically, the width of the yoke core (difference between the outside diameter and the inside diameter) is decided by back-calculation from the design magnetic flux density of the coil and the laminate thickness (height) of the yoke core (FIG. 35B(d)). Next, the coil thickness (height) and the GAP dimension between the magnetic leg cores are decided (S60) (FIG. 35B(e)). As described above, the necessary dimensions of the magnetic leg core and yoke core are decided and these values are judged in conjunction with the dimensions of individual parts of the reactor device, the connection with the stud, temperature and the characteristic of the reactor device and the like (S70) (FIG. 35B(f)). If the judgment result is 'YES', the design procedure is terminated. If the judgment result is 'NO', the design procedure returns to Step S10 to repeat this flow.

LIST OF REFERENCE SIGNS

10: Reactor device,
20,21: Top fastening fixture,
30,31: Bottom fastening fixture,
40,41,42,43: Coil terminal,
50: Eyenut,
51: Central fastening fixture on top fastening fixture,
55: Magnetic-leg-core positioning laminate,
56: Stud hole,
60: Zero-phase core,
70,71: Stud metal fixture,
80: Zero-phase core support,
81: Zero-phase core holder,
90,91: Stud,
92: Coil support fixture,
96: Locknut,
100,101,102: Coil,
120,123,125,127: Coil support fixture,
124,126,158: Insulating material,
130,131: Base,
132: Coil retainer holder,
133: Locknut,
134: Coil retainer,
140,141,142: Magnetic leg core,
143: Slit,
150: Coil support fixture
151: Coil Fastener,
152: Coil nut,
160,161,162: Yoke core,
163: Insulating material,
170,171,172,173,174: Laminate,
180: Insulating tube body,
181: Reinforcement metal plate,
190: Coil metal fixture,
191: Hole of coil metal fixture,
192: Claw of coil metal fixture,
201: Caster,
205: Band,
211: Vent hole,
212,214: Air Flow,
213: Gap,
215: Fan,
220,221: Coil terminal,
300: Inside diameter of yoke core,
301: Chordal chamfer,
302: Arcuate chamfer,
310: Coil thickness,
400: Sound absorbing material.

The invention claimed is:

1. A reactor device comprising:

a yoke core, including an upper yoke core and a lower yoke core, formed by toroidally winding an amorphous ribbon; a plurality of magnetic leg cores formed of the amorphous ribbon; and a coil wound around each of the magnetic leg cores, wherein the lower yoke core is disposed in a circular bottom fastening fixture, the magnetic leg cores are stacked and arranged at three places on a circumference of the yoke core with equal spacing, the coil is fitted around each of the magnetic leg cores, the upper yoke core is disposed atop the magnetic leg cores, the upper yoke core is capped with a top fastening fixture, three studs are arranged around the circular bottom fastening fixture and the top fastening fixture with equal spacing and another stud is disposed at the center, and the circular bottom fastening fixture and the top fastening fixture are fastened and fixed by the studs; wherein an insulating material is wound around an outside periphery of the yoke core and wherein the plurality of magnetic leg cores is formed by stacking the magnetic leg cores with laminate interposed therebetween, and assembling an insulating tube body by fitting the insulating tube body around the stacked magnetic leg cores.

2. The reactor device according to claim 1, wherein an annular metal plate is formed on an inner peripheral surface of a hole of the yoke core.

3. The reactor device according to claim 1, wherein a coil fastener is formed of an elongate metal plate and centrally formed with a hole for the stud to penetrate, the coil fasteners sandwiching lower and upper ends of the coil therebetween and fastening and fixing the coil by tightening a locknut mounted to the stud.

4. The reactor device according to claim 1, wherein a coil metal fixture for fixing the coil is formed of a metal plate having a predetermined width which is extended from the center of the reactor device in three directions and folded on respective lines at a distance from the reactor center to a gap between the magnetic leg core and the coil so as to define an L-shape, the coil metal fixture centrally formed with a stud hole, and the coil metal fixture is mounted to the three coils by insertion from one direction of the coils and fixed thereto by means of the stud.

5. The reactor device according to claim 1, wherein a band is wound around the three coils of the reactor device to fasten and fix the coils in position.

6. The reactor device according to claim 1, wherein either of or both of the top fastening fixture and the bottom fastening fixture are formed with a vent hole in vicinity of the center thereof.

7. The reactor device according to claim 1, wherein of the three coils, a gap is formed between adjoining coils.

8. The reactor device according to claim 1, wherein a fan is provided at the vent hole in vicinity of the center of the top fastening fixture or the bottom fastening fixture.

9. The reactor device according to claim 1, wherein an insulating board for gap adjustment is disposed in a gap between the coil and each of the magnetic leg cores.

10. A reactor device comprising:

a yoke core, including an upper yoke core and a lower yoke core, formed by toroidally winding an amorphous ribbon; a plurality of magnetic leg cores formed in a cylindrical configuration by winding the amorphous ribbon into a toroidal configuration and axially cutting the toroidal configuration; and a coil wound around each of the magnetic leg cores having a circular cross section, wherein the lower yoke core is disposed in a circular bottom fastening fixture, the magnetic leg cores are stacked and arranged at three places on a circumference of the yoke core with equal spacing, the coils are fitted around the stacked magnetic leg cores, the upper yoke core is disposed atop the magnetic leg cores, the upper yoke core is capped with a circular top fastening fixture, three studs are arranged around the circular bottom fastening fixture and the circular top fastening fixture with equal spacing, another stud is disposed at the center, and the circular bottom fastening fixture and the circular top fastening fixture are fastened and fixed by the studs; wherein an insulating material is wound around an outside periphery of the yoke core and wherein the plurality of magnetic leg cores is formed by stacking the magnetic leg cores with laminate interposed therebetween, and assembling an insulating tube body by fitting the insulating tube body around the stacked magnetic leg cores.

11. A reactor device comprising:

a yoke core, including an upper yoke core and a lower yoke core, formed by toroidally winding an amorphous ribbon; a plurality of magnetic leg cores formed of the amorphous ribbon in a fan-like configuration; and a coil wound around each of the magnetic leg cores having a fan-like cross section, wherein the lower yoke core is disposed in a substantially hexagonal bottom fastening fixture, the magnetic leg cores are stacked and arranged at three places on a circumference of the yoke core with equal spacing, the coils are fitted around the magnetic leg cores having the fan-like configuration, the upper yoke core is disposed atop the magnetic leg cores, the upper yoke core is capped with a top fastening fixture, studs are arranged around the substantially hexagonal bottom fastening fixture and the top fastening fixture at central positions of respectively corresponding three sides of the fastening fixtures and another stud is disposed centrally of the substantially hexagonal bottom fastening fixture and the top fastening fixture, and the substantially hexagonal bottom fastening fixture and the top fastening fixture are fastened and fixed by the studs; wherein an insulating material is wound around an outside periphery of the yoke core and wherein the plurality of magnetic leg cores is formed by stacking the magnetic leg cores with laminate interposed therebetween, and assembling an insulating tube body by fitting the insulating tube body around the stacked magnetic leg cores.

12. The reactor device according to claim 11, wherein the fan-like configuration has an apex angle of 120°±10°.

13. The reactor device according to claim 11, wherein the substantially hexagonal bottom fastening fixture and the top fastening fixture have a substantially hexagonal configuration.

14. The reactor device according to claim 11, wherein each of the magnetic leg cores is positioned by contacting an apex angle portion of the magnetic leg core against a core positioning laminate having an equilateral triangular shape.

15. The reactor device according to claim 11, wherein each of the magnetic leg cores has a fan-like cross section, and when the magnetic leg cores and the yoke core are arranged, the both cores define an overlap therebetween and a portion of the magnetic leg core that is out of the overlap is chamfered.

16. The reactor device according to claim 11, wherein each of the magnetic leg cores is chamfered on an arcuate line or chordal line.

17. The reactor device according to claim 11, wherein a cross section of each of the magnetic leg cores is a deformed fan shape obtained by cutting off opposite acute-angled ends of the fan and defining respective inner angles of 90° or more.

18. The reactor device according to claim 11, wherein provided that the magnetic leg cores and the yoke core are arranged, that R1 denotes the distance from the apex of the magnetic leg core having the fan-like cross section to the inner circle of the yoke core, and that R2 denotes the distance from the apex of the magnetic leg core to the outer circle of the yoke core, the cross-sectional area of the fan-like magnetic leg core is $0.47R2^2$-$0.96R1^2$ or more.

19. A method for determining dimensions of a reactor device that includes a yoke core, including an upper yoke core and a lower yoke core, formed by toroidally winding an amorphous ribbon;

three magnetic leg cores formed by winding the amorphous ribbon into a toroidal configuration and axially cutting the toroidal configuration into a fan-like configuration;

and a coil wound around each of the three magnetic leg cores, the method comprising:

selecting a number of coil turns and a coil height, deciding a cross-sectional profile of the magnetic leg cores, arranging the three magnetic leg cores and coils on a circle, deciding an inside diameter and an outside diameter of the yoke core, deciding a width of the yoke core, deciding a coil height and a gap dimension between the magnetic leg cores, and setting dimensions of the coil, the magnetic leg cores and the yoke core, judging individual dimensions according to overall dimension, temperature, characteristics of reactor and connection with a stud, and returning to the selecting step if a judgment result of the judging is NO but terminating setting of the dimensions if the judgment result is YES; wherein an insulating material is wound around an outside periphery of the yoke core and wherein the plurality of magnetic leg cores is formed by stacking the magnetic leg cores with laminate interposed therebetween, and assembling an insulating tube body by fitting the insulating tube body around the stacked magnetic leg cores.

* * * * *